US009181714B2

(12) United States Patent
MacDonald et al.

(10) Patent No.: US 9,181,714 B2
(45) Date of Patent: Nov. 10, 2015

(54) MULTI-TEXTURED OR PATTERNED EXPOSED SURFACE OF A LANDSCAPING BLOCK, WALL BLOCK, PATIO BLOCK AND BLOCK SYSTEM

(71) Applicants: Robert A. MacDonald, Plymouth, MN (US); Thomas S. Riccobene, Albuquerque, NM (US)

(72) Inventors: Robert A. MacDonald, Plymouth, MN (US); Thomas S. Riccobene, Albuquerque, NM (US)

(73) Assignee: KEYSTONE RETAINING WALL SYSTEMS LLC, West Chester, OH (US)

( * ) Notice: Subject to any disclaimer, the term of this patent is extended or adjusted under 35 U.S.C. 154(b) by 0 days.

(21) Appl. No.: 14/190,630

(22) Filed: Feb. 26, 2014

(65) Prior Publication Data

US 2014/0237926 A1 Aug. 28, 2014

Related U.S. Application Data

(60) Provisional application No. 61/770,622, filed on Feb. 28, 2013.

(51) Int. Cl.
*E04F 13/00* (2006.01)
*E04F 15/00* (2006.01)
(Continued)

(52) U.S. Cl.
CPC . *E04F 15/02* (2013.01); *E01C 5/00* (2013.01); *E01C 2201/06* (2013.01)

(58) Field of Classification Search
CPC ..... E04F 13/14; E04F 15/02; E04C 1/00; E04C 1/24; E04C 2/46; E04B 2002/0267; E04B 2002/0206
USPC ..... 52/311.1, 311.2, 306, 307, 308, 503, 52/504, 505, 574, 575, 596, 603, 604, 605, 52/612; 405/16, 284, 286; 404/27–42
See application file for complete search history.

(56) References Cited

U.S. PATENT DOCUMENTS 1,794,572 A 3/1931 Wyatt
1,949,079 A 2/1934 Loeffler
(Continued)

FOREIGN PATENT DOCUMENTS

DE 10016 680 A1 10/2001
GB 248234 A 3/1926
(Continued)

OTHER PUBLICATIONS

Abstract for DE 10016 680 A1 (2 pages).
(Continued)

*Primary Examiner* — Mark Wendell
(74) *Attorney, Agent, or Firm* — Popovich, Wiles & O'Connell, P.A.

(57) ABSTRACT

A landscaping block, patio block, wall block and/or retaining wall block having a multi-textured or patterned exposed surface that can be used in landscaping, retaining wall, and/or patio block systems utilizing a plurality of blocks with a multi-textured or patterned exposed surface. The blocks having the multi-textured or patterned exposed surface can be used in landscaping, retaining wall, and/or patio block systems having a first block type and a second block type. The multi-textured or patterned exposed surface blocks can be used in the construction of walls, fences, and patios to create a geometric design or pattern or a repeating geometric design or pattern in a visually exposed surface of the wall, fence and/or patio constructed.

20 Claims, 23 Drawing Sheets

(51) Int. Cl.
*E04F 15/02* (2006.01)
*E01C 5/00* (2006.01)

(56) References Cited

U.S. PATENT DOCUMENTS

| | | | | |
|---|---|---|---|---|
| 2,131,803 | A | 10/1938 | Henderson | |
| 4,094,380 | A | 6/1978 | Kobayashi et al. | |
| D299,971 | S * | 2/1989 | Gilbert | D25/138 |
| 5,252,017 | A | 10/1993 | Hodel | |
| D366,704 | S | 1/1996 | Bryant | |
| 5,568,994 | A | 10/1996 | Dawson | |
| 5,601,384 | A | 2/1997 | Dawson | |
| D380,560 | S | 7/1997 | Forsberg | |
| D381,086 | S | 7/1997 | Forsberg | |
| D384,168 | S | 9/1997 | Stevenson | |
| D387,434 | S | 12/1997 | Dawson | |
| D397,230 | S | 8/1998 | Forsberg | |
| D397,451 | S | 8/1998 | Stevenson | |
| D397,808 | S | 9/1998 | Dawson | |
| 5,865,006 | A | 2/1999 | Dawson | |
| 5,913,790 | A | 6/1999 | Dawson | |
| D430,308 | S | 8/2000 | Dawson | |
| 6,149,352 | A | 11/2000 | MacDonald | |
| 6,178,715 | B1 | 1/2001 | Pacitto et al. | |
| D451,208 | S | 11/2001 | Falconer | |
| D462,785 | S | 9/2002 | Aurelius | |
| 6,536,994 | B2 | 3/2003 | Race | |
| D479,340 | S | 9/2003 | Sooferian | |
| 6,615,561 | B2 | 9/2003 | MacDonald et al. | |
| 6,709,201 | B2 | 3/2004 | Race | |
| D488,242 | S | 4/2004 | MacDonald | |
| D488,568 | S | 4/2004 | MacDonald | |
| D488,569 | S | 4/2004 | Dawson | |
| D490,542 | S | 5/2004 | MacDonald | |
| 6,803,002 | B2 | 10/2004 | Suto et al. | |
| 6,821,058 | B1 | 11/2004 | Dawson | |
| D501,935 | S | 2/2005 | Dawson et al. | |
| 6,854,231 | B2 | 2/2005 | MacDonald et al. | |
| 6,912,823 | B2 | 7/2005 | MacDonald et al. | |
| 7,011,474 | B2 | 3/2006 | MacDonald | |
| D521,654 | S * | 5/2006 | Anderson et al. | D25/113 |
| 7,168,892 | B1 | 1/2007 | MacDonald et al. | |
| 7,448,830 | B2 | 11/2008 | MacDonald et al. | |
| D582,056 | S | 12/2008 | Plies | |
| D582,057 | S | 12/2008 | Plies | |
| 7,641,178 | B2 | 1/2010 | MacDonald et al. | |
| D610,710 | S | 2/2010 | LaCroix et al. | |
| 7,654,776 | B2 | 2/2010 | MacDonald et al. | |
| 7,687,005 | B2 | 3/2010 | Skidmore et al. | |
| D618,823 | S | 6/2010 | Lallas | |
| D620,615 | S | 7/2010 | MacDonald et al. | |
| 7,780,141 | B2 | 8/2010 | Dawson et al. | |
| 7,934,351 | B2 | 5/2011 | Clarno | |
| 7,971,407 | B2 | 7/2011 | MacDonald | |
| D645,982 | S | 9/2011 | Amend | |
| D656,244 | S | 3/2012 | MacDonald et al. | |
| D656,625 | S | 3/2012 | MacDonald et al. | |
| D660,460 | S | 5/2012 | Dixon et al. | |
| D661,408 | S | 6/2012 | Riccobene | |
| D701,325 | S * | 3/2014 | MacDonald et al. | D25/113 |
| 8,769,897 | B2 * | 7/2014 | Kikuchi et al. | 52/385 |
| 2005/0005550 | A1 * | 1/2005 | Schrunk | 52/385 |
| 2006/0110223 | A1 | 5/2006 | Dawson | |
| 2007/0166102 | A1 | 7/2007 | Cornaz | |
| 2008/0174049 | A1 | 7/2008 | Hammer et al. | |
| 2008/0277561 | A1 | 11/2008 | MacDonald | |
| 2008/0289282 | A1 | 11/2008 | MacDonald | |
| 2008/0302350 | A1 | 12/2008 | LaCroix | |
| 2008/0307740 | A1 | 12/2008 | MacDonald | |
| 2008/0313988 | A1 | 12/2008 | MacDonald | |
| 2009/0120029 | A1 | 5/2009 | LaCroix et al. | |
| 2009/0151281 | A1 | 6/2009 | MacDonald et al. | |
| 2009/0188196 | A1 | 7/2009 | MacDonald | |
| 2009/0308015 | A1 | 12/2009 | MacDonald et al. | |
| 2009/0313936 | A1 | 12/2009 | MacDonald et al. | |
| 2010/0308502 | A1 | 12/2010 | LaCroix et al. | |
| 2010/0310695 | A1 | 12/2010 | LaCroix et al. | |
| 2011/0072753 | A1 | 3/2011 | MacDonald | |
| 2011/0217127 | A1 | 9/2011 | MacDonald | |
| 2011/0243669 | A1 | 10/2011 | Friederichs et al. | |

FOREIGN PATENT DOCUMENTS

| | | | |
|---|---|---|---|
| GB | 944066 | A | 12/1963 |
| GB | 2 168 399 | A | 6/1986 |
| WO | WO 2005/084900 | A1 | 9/2005 |

OTHER PUBLICATIONS

PCT International Search Report for International Application No. PCT/US2014/018660 (10 pages).

* cited by examiner

MULTI-TEXTURED OR PATTERNED EXPOSED SURFACE OF A LANDSCAPING BLOCK, WALL BLOCK, PATIO BLOCK AND BLOCK SYSTEM

FIELD OF THE INVENTION

This invention relates generally to multi-textured or patterned exposed surfaces of landscaping blocks, retaining wall blocks, wall blocks and patio blocks. This invention also relates generally to landscaping, retaining wall, and patio block systems with one or more similar blocks having a multi-textured or patterned exposed surface and to block systems with one or more different types of blocks having a multi-textured or patterned exposed surface.

BACKGROUND OF THE INVENTION

Patios, fences, walls, and retaining walls are used in various landscaping projects and are available in a wide variety of styles. Numerous methods and materials exist for the construction of patios, fences, walls and retaining walls. Such methods include the use of natural stone, poured concrete, precast panels, masonry, and landscape timbers or railroad ties.

In recent years, segmental concrete wall, patio and landscaping units, which may be laid, positioned or dry stacked without the use of mortar or other complex securing means, have become widely accepted in the construction of patios, fences, walls and retaining walls. Such patio, wall and landscaping units have gained popularity because they are mass produced and, consequently, relatively inexpensive. They are structurally sound, easy and relatively inexpensive to install, and couple the durability of concrete with the attractiveness of various architectural finishes.

In the manufacture of patio, wall and landscaping blocks and other kinds of blocks made from concrete, it is common to use a mold that forms a block module which is then split to form two or more blocks. Another method is wherein blocks are individually formed in a mold and the surfaces are textured by removal of the mold. Another known method of creating a block having an irregular or textured surface is to form the block in a mold box that has been provided with a sidewall liner shaped to impart the irregular or textured surface on the block during the block molding process.

In the construction of a patio, wall or fence the aesthetic design of the individual block units and the overall visually pleasing aesthetic appearance of the patio, wall or fence is very desirable. Blocks that have a desirable texture or pattern create an exposed surface of a patio, wall or fence that is visually appealing.

It would be desirable to provide a patio, wall or landscaping block with a multi-textured or patterned exposed surface for use in constructing a wall, retaining wall, fence, patio or the like. It would be further desirable to provide a block with a multi-textured pattern or textured surface that could create multiple desirable and aesthetic designs in an exposed surface of a patio, wall, fence or the like.

It would be desirable to provide a patio, wall or landscaping block having a chamfer on the sides and top of the front face of the block, to reduce the probability of sustaining damage to the block edges during manufacture, plant-handling, transportation and site installation handling. It would further be desirable that the sides and top of the front face of the wall block have an angled chamfer which creates block edges that are greater than 90° from a vertical plane formed from the sides and front of the block. The greater than 90° edges are harder to chip off or wear away during manufacture, plant-handling, transportation and site installation handling, and thereby minimize any damage to block edges.

It would be desirable to provide a system of multi-textured or patterned blocks for constructing a patio, wall or fence that combines the ease of installation of modern segmental wall blocks, patio blocks and landscaping blocks with the attractive appearance of an aesthetic design.

It would be desirable to provide a block system for constructing a wall, patio or fence that utilizes a block that has a multi-textured or patterned exposed surface that allows complex designs or patterns to be formed or created onto an exposed surface of the constructed wall, patio or fence such that the contrast and/or differences between a first pattern or texture and a second pattern or texture (and the differences between other additional patterns and textures as desired) would create the pattern or design onto the overall visually exposed surfaces of the wall, patio or fence. It would further be desirable to provide a block system for constructing a wall, patio or fence that utilizes a first block type that has a multi-textured or patterned exposed surface and a second block type that has a multi-textured or patterned exposed surface that would allow for more complex designs or patterns to be formed or created into an exposed surface of the constructed wall, patio or fence.

SUMMARY OF THE INVENTION

A landscaping block including a block body having a first side surface opposed a from a second side surface, a third side surface opposed from a fourth side surface, and opposed and substantially parallel top and bottom surfaces. The top surface of the landscaping block has a total upper area on a horizontal plane, the total upper area of the upper surface having a first area with a first pattern or texture and a second area with a second pattern or texture. The first pattern or texture is different from the second pattern or texture.

The landscaping block may include that the top surface has a recessed surface that divides the first area of the total upper area of the top surface from the second area of the total upper area of the top surface. The landscaping block may include that the first area of the total upper area of the top surface is substantially equal in size to the second area of the total upper area of the top surface. The landscaping block may include that one of the first or second areas of the total upper area of the top surface is greater than the other of the first or second areas of the total upper area of the top surface.

The landscaping block may include that the first area extends the entire distance across the total upper area from the third side surface to the fourth side surface and a partial distance across the total upper area from the first side surface toward the second side surface and that the second area extends the entire distance across the total upper area from the third side surface to the fourth side surface and a partial distance across the total upper area from the second side surface toward the first side surface. The landscaping block may further include that the first area extends across the total upper area of the top surface from the first side surface toward the second side surface along the third side surface more than half of the length of the third side surface. The landscaping block may further include that the first area extends across the total upper area of the top surface from the first side surface toward the second side surface along the fourth side surface a distance less than half of the length of the fourth side surface. The landscaping block may further include that the second area extends across the upper area of the top surface from the second side surface toward the first side surface along the third side surface a distance less than half of the length of the third side surface and the second area extends across the upper area of the top surface from the second side surface toward the first side surface along the fourth side surface a distance more than half of the length of the fourth side surface.

The landscaping block may include that the top surface has a recessed surface that divides the first area of the total upper area of the top surface from the second area of the total upper area of the top surface. The landscaping block may further include that the first, second, third and fourth side surfaces have an angular surface adjacent the top surface.

The landscaping block may include that the total upper area of the top surface of the landscaping block has a third area. The landscaping block may include that the third area has the same pattern or texture as the first area or second area. The landscaping block may include that the third area has a different pattern or texture as the first area or second area. The landscaping block may include that the total upper area of the top surface of the landscaping block has a fourth area. The landscaping block may include that the third area has the same pattern or texture as the first area or second area and the fourth area has the same pattern as the other of the first area or second area. The landscaping block may include that the third area has a different pattern or texture as the first area or second area and the fourth area has a different pattern or texture as the first, second or third areas.

A block including a block body having a first side surface opposed a from a second side surface, a front surface opposed from a back surface, and opposed and substantially parallel top and bottom surfaces. The front surface of the block has a total exposed area, the total exposed area of the front surface has a first area with a first pattern or texture and a second area with a second pattern or texture. The first pattern or texture is different from the second pattern or texture.

The block may include that the first area of the total exposed area of the front surface is substantially equal in size to the second area of the total exposed area of the front surface. The block may include that one of the first or second areas of the total exposed area of the front surface is greater than the other of the first or second areas of the total exposed area of the front surface. The block may include that the total exposed area of the front surface is on the same vertical plane. The block may include that the first area of the front surface is on a different vertical plane than the second area of the front surface.

The block may include that the back surface has a total exposed area wherein the total exposed area of the back surface has a first area with a first pattern or texture and a second area with a second pattern or texture, the first pattern or texture being different from the second pattern or texture. The block may include that the total exposed area of the back surface is on the same vertical plane. The block may include that the first area of the back surface is on a different vertical plane than the second area of the back surface.

The block may include that the front surface has a recessed surface that divides the first area of the total exposed area of the front surface from the second area of the total exposed area of the front surface. The block may include that the first area of the total exposed area of the front surface is substantially equal in size to the second area of the total exposed area of the front surface. The block may include that one of the first or second areas of the total exposed area of the front surface is greater than the other of the first or second areas of the total exposed area of the front surface.

The block may include that the first area extends the entire distance across the total exposed area from the top surface to the bottom surface and a partial distance across the total exposed area from the first side surface toward the second side surface and that the second area extends the entire distance across the total exposed area from the top surface to the bottom surface and a partial distance across the total exposed area from the second side surface toward the first side surface. The block may further include that the first area extends across the total exposed area of the front surface from the first side surface toward the second side surface along the top surface more than half of the length of the top surface. The block may further include that the first area extends across the total exposed area of the front surface from the first side surface toward the second side surface along the bottom surface a distance less than half of the length of the bottom surface. The block may further include that the second area extends across the total exposed area of the front surface from the second side surface toward the first side surface along the top surface a distance less than half of the length of the top surface and the second area extends across the total exposed area of the front surface from the second side surface toward the first side surface along the bottom surface a distance more than half of the length of the bottom surface.

The block may include that the front surface has a recessed surface that divides the first area of the total exposed area of the front surface from the second area of the total exposed area of the front surface. The block may further include that the first side, second side, top and bottom surfaces have an angular surface adjacent the front surface.

The block may include that the total exposed area of the front surface of the block has a third area. The block may include that the third area has the same pattern or texture as the first area or second area. The block may include that the third area has a different pattern or texture as the first area or second area. The block may include that the total exposed area of the front surface of the block has a fourth area. The block may include that the third area has the same pattern or texture as the first area or second area and the fourth area has the same pattern as the other of the first area or second area. The block may include that the third area has a different pattern or texture as the first area or second area and the fourth area has a different pattern or texture as the first, second or third areas.

A wall block system including a plurality of wall blocks. The wall blocks of the wall block system have a block body with a first side surface opposed a from a second side surface, a front surface opposed from a back surface, and opposed and substantially parallel top and bottom surfaces. The front surface of the wall block has a total exposed area on a vertical plane, the total exposed area of the front surface having a first area with a first pattern or texture and a second area with a second pattern or texture, the first pattern or texture being different from the second pattern or texture. The wall block system including that when a wall is formed from the plurality of blocks stacked in multiple courses, the first side or the second side surface of a wall block in a course of wall blocks is positioned adjacent to either the first side surface or the second side surface of an adjacent wall block in the course of wall blocks and that the top surface or bottom surface of a wall block in a first course of wall blocks may be positioned adjacent to either the top surface or bottom surface of an adjacent wall block in an adjacent second course of wall blocks.

The wall block system may include that the first area of the plurality of wall blocks extends the entire distance across the total exposed area from the top surface to the bottom surface and a partial distance across the total exposed area from the first side surface toward the second side surface and that the second area of the plurality of wall blocks extends the entire distance across the total exposed area from the top surface to the bottom surface and a partial distance across the total exposed area from the second side surface toward the first side surface. The wall block system may further include that the first area of the plurality of wall blocks extends across the total exposed area of the front surface from the first side surface toward the second side surface along the top surface more than half of the length of the top surface. The wall block system may further include that the first area of the plurality of wall blocks extends across the total exposed area of the front surface from the first side surface toward the second side surface along the bottom surface a distance less than half of the length of the bottom surface. The wall block system may further include that the second area of the plurality of wall blocks extends across the total exposed area of the front surface from the second side surface toward the first side surface along the top surface a distance less than half of the length of the top surface and that the second area extends across the total exposed area of the front surface from the second side surface toward the first side surface along the bottom surface a distance more than half of the length of the bottom surface.

The wall block system may include that the front surface of the plurality of wall blocks has a recessed surface that divides the first area of the total exposed area of the front surface from the second area of the total exposed area of the front surface. The wall block system may further include that the first side, second side, top and bottom surfaces have an angular surface adjacent the front surface.

The wall block system may include that the first side surface of a wall block is laid adjacent only to the first side surface of an adjacent wall block in a course of blocks. The wall block system may include that the top surface of a wall block is positioned adjacent to only the top surface of an adjacent wall block in an adjacent course of blocks. The wall block system may further include that the top surface of a wall block is positioned adjacent to only the bottom surface of an adjacent wall block in an adjacent course of blocks.

The wall block system may include that the first side surface of a wall block is laid adjacent only to the second side surface of an adjacent wall block in a course of blocks. The wall block system may include that the top surface of a wall block is positioned adjacent to only the top surface of an adjacent wall block in an adjacent course of blocks. The wall block system may include that the top surface of a wall block is positioned adjacent to only the bottom surface of an adjacent wall block in an adjacent course of blocks.

The wall block system may include that the back surface of the wall block has a total exposed area. The total exposed area of the back surface has a first area with a first pattern or texture and a second area with a second pattern or texture, the first pattern or texture being different from the second pattern or texture. The wall block system may further include that the total exposed area of the back surface is on the same vertical plane. The wall block system may further include that the first area of the back surface is on a different vertical plane than the second area of the back surface. The wall block system may further include that the wall is formed from the plurality of blocks stacked in multiple courses the front side of a wall block in a course of wall blocks is positioned adjacent to either the front surface or the back surface of an adjacent wall block in the course of wall blocks.

A wall block including a block body having a first side surface opposed a from a second side surface, a front surface opposed from a back surface, and opposed and substantially parallel top and bottom surfaces. The front surface has a total exposed area. The total exposed area of the front surface has a first area with a first pattern or texture on a first vertical plane and a second area with a second pattern or texture on a second vertical plane, the first pattern or texture being different from the second pattern or texture and the first vertical plane being different than the second vertical plane.

The wall block may include that the first area of the total exposed area of the front surface is substantially equal in size to the second area of the total exposed area of the front surface.

The wall block may include that the first area extends the entire distance across the total exposed area from the top surface to the bottom surface and a partial distance across the total exposed area from the first side surface toward the second side surface and wherein the second area extends the entire distance across the total exposed area from the top surface to the bottom surface and a partial distance across the total exposed area from the second side surface toward the first side surface. The wall block may further include that the first area extends across the total exposed area of the front surface from the first side surface toward the second side surface along the top surface more than half of the length of the top surface. The wall block may further include that the first area extends across the total exposed area of the front surface from the first side surface toward the second side surface along the bottom surface a distance less than half of the length of the bottom surface. The wall block may further include that the second area extends across the total exposed area of the front surface from the second side surface toward the first side surface along the top surface a distance less than half of the length of the top surface and the second area extends across the total exposed area of the front surface from the second side surface toward the first side surface along the bottom surface a distance more than half of the length of the bottom surface.

The wall block may include that the front surface has a recessed surface that divides the first area of the total exposed area of the front surface from the second area of the total exposed area of the front surface. The wall block may further include that the first side, second side, top and bottom surfaces have an angular surface adjacent the front surface.

The wall block of claim may include that the back surface has a total exposed area. The total exposed area of the back surface has a first area with a first pattern or texture and a second area with a second pattern or texture, the first pattern or texture being different from the second pattern or texture. The wall block may further include that the first area of the back surface is on a different vertical plane than the second area of the back surface.

A wall system including a plurality of wall blocks. The wall blocks of the wall system have a block body with a first side surface opposed from a second side surface, a front surface opposed from a back surface, and opposed and substantially parallel top and bottom surfaces, the front surface having a total exposed area. The total exposed area of the front surface has a first area with a first pattern or texture on a first vertical plane and a second area with a second pattern or texture on a second vertical plane, the first pattern or texture being different from the second pattern or texture and the first vertical plane being different than the second vertical plane. The wall system including that when a wall is formed from the plurality of blocks stacked in multiple courses the first side or the second side surface of a wall block in a course of wall blocks is positioned adjacent to either the first side surface or the second side surface of an adjacent wall block in the course of wall blocks and the top surface or bottom surface of a wall block in a first course of wall blocks may be positioned adjacent to either the top surface or bottom surface of an adjacent wall block in an adjacent second course of wall blocks.

The wall block system may include that the first area of the total exposed area of the front surface is substantially equal in size to the second area of the total exposed area of the front surface.

The wall block system may include that the first area extends the entire distance across the total exposed area from the top surface to the bottom surface and a partial distance across the total exposed area from the first side surface toward the second side surface and that the second area extends the entire distance across the total exposed area from the top surface to the bottom surface and a partial distance across the total exposed area from the second side surface toward the first side surface. The wall block system may further include that the first area extends across the total exposed area of the front surface from the first side surface toward the second side surface along the top surface more than half of the length of the top surface. The wall block system may further include that the first area extends across the total exposed area of the front surface from the first side surface toward the second side surface along the bottom surface a distance less than half of the length of the bottom surface. The wall block system may further include that the second area extends across the total exposed area of the front surface from the second side surface toward the first side surface along the top surface a distance less than half of the length of the top surface and the second area extends across the total exposed area of the front surface from the second side surface toward the first side surface along the bottom surface a distance more than half of the length of the bottom surface.

The wall block system may include that the front surface has a recessed surface that divides the first area of the total exposed area of the front surface from the second area of the total exposed area of the front surface. The wall block system may further include that the first side, second side, top and bottom surfaces have an angular surface adjacent the front surface.

The wall block system may include that the first side surface of a wall block is laid adjacent only to the first side surface of an adjacent wall block in a course of blocks. The wall block system may include that the top surface of a wall block is positioned adjacent to only the top surface of an adjacent wall block in an adjacent course of blocks. The wall block system may include that the top surface of a wall block is positioned adjacent to only the bottom surface of an adjacent wall block in an adjacent course of blocks.

The wall block system may include that the first side surface of a wall block is laid adjacent only to the second side surface of an adjacent wall block in a course of blocks. The wall block system may include that the top surface of a wall block is positioned adjacent to only the top surface of an adjacent wall block in an adjacent course of blocks. The wall block system may include that the top surface of a wall block is positioned adjacent to only the bottom surface of an adjacent wall block in an adjacent course of blocks.

The wall block system may include that the back surface has a total exposed area. The total exposed area of the back surface has a first area with a first pattern or texture and a second area with a second pattern or texture, the first pattern or texture being different from the second pattern or texture. The wall block system may further include that the first area of the back surface is on a different vertical plane than the second area of the back surface.

A patio system including a plurality of patio blocks. The patio blocks of the patio system have a first side surface opposed a from a second side surface, a third side surface opposed from a fourth side surface, and opposed and substantially parallel top and bottom surfaces, the top surface having a total upper area on a horizontal plane. The total upper area of the upper surface has a first area with a first pattern or texture and a second area with a second pattern or texture, the first pattern or texture being different from the second pattern or texture. The patio system including that when a patio is made with the plurality of patio blocks, any of the first, second, third or fourth side surfaces of a patio block may be laid adjacent to any of the first, second, third or fourth side surfaces of an adjacent patio block.

The patio system may include that the first area of the total upper area of the top surface is substantially equal in size to the second area of the total upper area of the top surface.

The patio system may include that the first area extends the entire distance across the total upper area from the third side surface to the fourth side surface and a partial distance across the total upper area from the first side surface toward the second side surface and that the second area extends the entire distance across the total upper area from the third side surface to the fourth side surface and a partial distance across the total upper area from the second side surface toward the first side surface. The patio system may further include that the first area extends across the total upper area of the top surface from the first side surface toward the second side surface along the third side surface more than half of the length of the third side surface. The patio system may further include that the first area extends across the total upper area of the top surface from the first side surface toward the second side surface along the fourth side surface a distance less than half of the length of the fourth side surface. The patio system may further include that the second area extends across the upper area of the top surface from the second side surface toward the first side surface along the third side surface a distance less than half of the length of the third side surface and the second area extends across the upper area of the top surface from the second side surface toward the first side surface along the fourth side surface a distance more than half of the length of the fourth side surface.

The patio system may include that the first side surface of a patio block is laid adjacent only to the first side surface of an adjacent patio block. The patio system may include that the second side surface of a patio block is laid adjacent only to the second side surface of an adjacent patio block. The patio system may include that the second side surface of a patio block is laid adjacent only to the third side surface or fourth side surface of an adjacent patio block.

The patio system may include that the first side surface of a patio block is laid adjacent only to the second side surface of an adjacent patio block. The patio system may include that the third side surface of a patio block is laid adjacent only to the third side surface or fourth side surface of an adjacent patio block.

The patio system may include that the first side surface of a patio block is laid adjacent only to the third side surface of an adjacent patio block. The patio system may include that the second side surface of a patio block is laid adjacent only to the fourth side surface of an adjacent patio block.

A patio system including a plurality of a first type of patio blocks and a second type of patio blocks. The first and second patio block types having a block body with a first side surface opposed a from a second side surface, a third side surface opposed from a fourth side surface, and opposed and substantially parallel top and bottom surfaces, the top surface having a total upper area on a horizontal plane. The total upper area of the top surface of the first and second types of patio blocks have a first area with a first pattern or texture and a second area with a second pattern or texture, the first pattern or texture being different from the second pattern or texture. The lengths of the first, second, third and fourth side surfaces of the second patio block type are less than the lengths of the first, second third and fourth side surfaces of the first patio block type. The patio system including that when a patio is made with the plurality of patio blocks, any of the first, second, third or fourth side surfaces of either the first or second patio block type may be laid adjacent to any of the first, second, third or fourth side surfaces of an adjacent first or second patio block type.

The patio system may include that the first area of the total upper area of the top surface of the first and second patio block types is substantially equal in size to the second area of the total upper area of the top surface of the first and second patio block types, respectively.

The patio system may include that the first area of the first and second patio block types extends the entire distance across the total upper area from the third side surface to the fourth side surface and a partial distance across the total upper area from the first side surface toward the second side surface and that the second area of the first and second patio block types extends the entire distance across the total upper area from the third side surface to the fourth side surface and a partial distance across the total upper area from the second side surface toward the first side surface. The patio system may further include that the first area of the first and second patio block types extends across the total upper area of the top surface from the first side surface toward the second side surface along the third side surface more than half of the length of the third side surface. The patio system may further include that the first area of the first and second patio block types extends across the total upper area of the top surface from the first side surface toward the second side surface along the fourth side surface a distance less than half of the length of the fourth side surface. The patio system may further include that the second area of the first and second patio block types extends across the upper area of the top surface from the second side surface toward the first side surface along the third side surface a distance less than half of the length of the third side surface and the second area of the first and second patio block types extends across the upper area of the top surface from the second side surface toward the first side surface along the fourth side surface a distance more than half of the length of the fourth side surface.

The patio system may include that each of the first, second, third and fourth side surfaces of a patio block from the second patio block type are laid adjacent to any of the first, second, third and fourth side surfaces of patio blocks from the first patio block type. The patio system may include that any two of the first, second, third and fourth side surfaces of a patio block of the first patio block type are laid adjacent to any of the first, second, third and fourth side surfaces of two of the patio blocks from the second patio block type. The patio system may include that each of the first, second, third and fourth side surfaces of a patio block of the first patio block type are laid adjacent to any of the first, second, third and fourth side surfaces of four of the patio blocks from the second patio block type.

The patio system may include that any two of the first, second, third and fourth side surfaces of a patio block of the first patio block type are laid adjacent to any of the first, second, third and fourth side surfaces of four of the patio blocks from the second patio block type.

A landscaping system having a patio and a wall or fence and including a plurality of patio blocks. The patio blocks of the landscaping system have a first side surface opposed a from a second side surface, a third side surface opposed from a fourth side surface, and opposed and substantially parallel top and bottom surfaces, the top surface having a total upper area on a horizontal plane. The total upper area of the top surface of the patio blocks has a first area with a first pattern or texture and a second area with a second pattern or texture, the first pattern or texture being different from the second pattern or texture. The landscaping system including a plurality of wall blocks. The wall blocks of the landscaping system have a block body with a first side surface opposed a from a second side surface, a front surface opposed from a back surface, and opposed and substantially parallel top and bottom surfaces, the front surface having a total exposed area on a vertical plane. The total exposed area of the front surface of the wall blocks has a first area with a first pattern or texture and a second area with a second pattern or texture, the first pattern or texture being different from the second pattern or texture. The system including that when a patio is made with the plurality of patio blocks, any of the first, second, third or fourth side surfaces of a patio block may be laid adjacent to any of the first, second, third or fourth side surfaces of an adjacent patio block. The landscaping system including that when a wall or fence is formed from the plurality of blocks stacked in multiple courses the first side or the second side surface of a wall block in a course of wall blocks is positioned adjacent to either the first side surface or the second side surface of an adjacent wall block in the course of wall blocks and the top surface or bottom surface of a wall block in a first course of wall blocks may be positioned adjacent to either the top surface or bottom surface of an adjacent wall block in an adjacent second course of wall blocks.

The landscaping system may include that the first area of the total upper area of the top surface of the patio block is substantially equal in size to the second area of the total upper area of the top surface of the patio block and the first area of the total exposed area of the front surface of the wall block is substantially equal in size to the second area of the total exposed area of the front surface of the wall block.

The landscaping system may include that the first area of the patio block extends the entire distance across the total upper area from the third side surface to the fourth side surface and a partial distance across the total exposed area from the first side surface toward the second side surface and wherein the second area extends the entire distance across the total upper area from the third surface to the fourth surface and a partial distance across the total upper area from the second side surface toward the first side surface.

The landscaping system may include that the top surface of the patio block has a recessed surface that divides the first area of the total upper area of the top surface from the second area of the total upper area of the top surface. The landscaping system may further include that the first side, second side, top and bottom surfaces of the patio block have an angular surface adjacent the front surface.

The landscaping system may include that the first area of the wall block extends the entire distance across the total exposed area from the top surface to the bottom surface and a partial distance across the total exposed area from the first side surface toward the second side surface and wherein the second area extends the entire distance across the total exposed area from the top surface to the bottom surface and a partial distance across the total exposed area from the second side surface toward the first side surface.

The landscaping system may include that the back surface of the plurality of wall blocks has a total exposed area wherein the total exposed area of the back surface has a first area with a first pattern or texture and a second area with a second pattern or texture, the first pattern or texture being different from the second pattern or texture. The landscaping system may further include that the total exposed area of the back surface is on the same vertical plane. The landscaping system may further include that the first area of the back surface is on a different vertical plane than the second area of the back surface.

The landscaping system may include that when the wall is formed from the plurality of blocks stacked in multiple courses the front side of a wall block in a course of wall blocks is positioned adjacent to either the front surface or the second back surface of an adjacent wall block in the course of wall blocks.

An exposed surface of a patio including a plurality of patio blocks. The plurality of patio blocks have a top surface that forms the exposed surface of the patio, the top surface of the plurality of patio blocks having a first trapezoidal area and a second trapezoidal area. The first trapezoidal area is substantially equal in shape and size to the second trapezoidal area and the first trapezoidal area has a different pattern or texture from the second trapezoidal area.

The exposed surface of a patio may include that the first trapezoidal area of the plurality of patio blocks extends a partial distance across the top surface of the plurality of patio blocks from a first side surface of the patio block to a second side surface of the patio block and the entire distance across the top surface from a third side surface of the patio block to a fourth side surface of the patio block. The exposed surface of a patio may further include that the second trapezoidal area extends the entire distance across the top surface of the patio block from the third surface to the fourth surface and a partial distance across the top surface of the patio block from the second side surface toward the first side surface.

The exposed surface of a patio may include that the plurality of patio blocks are positioned in courses or rows such that the first trapezoidal area of a first patio block in a row is positioned next to a second trapezoidal area of an adjacent block in a row. The exposed surface of a patio may include that the plurality of patio blocks are positioned in courses or rows such that the first trapezoidal area of a first patio block in a row is positioned adjacent to a first trapezoidal area of an adjacent block in a row. The exposed surface of a patio may include that the plurality of patio blocks are positioned in courses or rows such that the first side surface of a first patio block in a row is positioned adjacent to the third side surface of a patio block in a row. The exposed surface of a patio may include that the plurality of patio blocks are positioned in courses or rows such that the first side surface of a first patio block in a first row is positioned adjacent to the third side surface of a patio block in a first row and the third side surface of the first patio block of the first row is positioned adjacent to the first side surface of a patio block of a second row.

The exposed surface of a patio may include that the plurality of patio blocks are positioned in courses or rows such that the first side surface of a first patio block in a first row is positioned adjacent to the first side surface of a patio block in a first row and the third side surface of the first patio block of the first row is positioned adjacent to the fourth side surface of a patio block of a second row or the second side surface of a second row. The exposed surface of a patio may include that the plurality of patio blocks are positioned in courses or rows such that the first side surface of a first patio block in a row is positioned adjacent to the first side surface of a patio block in a row. The exposed surface of a patio may include that the plurality of patio blocks are positioned in courses or rows such that the first side surface of a first patio block in a row is positioned adjacent to the second side surface of a patio block in a row.

An exposed surface of a patio including a plurality of a first type of patio blocks having first, second, third and fourth side surfaces and a plurality of second types of patio blocks having first, second, third and fourth side surfaces. The first, second, third and fourth side surfaces of the second type of patio block having lengths, the lengths of at least two of the first, second, third and fourth side surfaces of the second type of patio block being less than a length of the first, second, third and fourth side surfaces of the first block type. The plurality of first and second types of patio blocks have a top surface that forms the exposed surface of the patio, the top surface of the plurality of patio blocks having a first trapezoidal area and a second trapezoidal area. The first trapezoidal area is substantially equal in shape and size to the second trapezoidal area and the first trapezoidal area has a different pattern or texture from the second trapezoidal area.

The exposed surface of a patio may include that the first trapezoidal area of the plurality of first and second types of patio blocks extends a partial distance across the top surface of the patio blocks from the first side surface of the patio block to the second side surface of the patio block and the entire distance across the top surface from the third side surface of the patio block to the fourth side surface of the patio block. The exposed surface of a patio may further include that the second trapezoidal area of the first and second types of patio blocks extends the entire distance across the top surface of the patio blocks from the third surface to the fourth surface and a partial distance across the top surface of the patio blocks from the second side surface toward the first side surface.

The exposed surface of a patio may include that each of the first, second, third and fourth side surfaces of a patio block from the second patio block type are laid adjacent to any of the first, second, third and fourth side surfaces of four patio blocks from the first patio block type. The exposed surface of a patio may include that any two of the first, second, third and fourth side surfaces of a patio block of the first patio block type are laid adjacent to any of the first, second, third and fourth side surfaces of two of the patio blocks from the second patio block type. The exposed surface of a patio may include that each of the first, second, third and fourth side surfaces of a patio block of the first patio block type are laid adjacent to any of the first, second, third and fourth side surfaces of four of the patio blocks from the second patio block type. The exposed surface of a patio may include that any two of the first, second, third and fourth side surfaces of a patio block of the first patio block type are laid adjacent to any of the first, second, third and fourth side surfaces of four of the patio blocks from the second patio block type.

BRIEF DESCRIPTION OF THE DRAWINGS

A preferred form of the present invention will now be described by way of example with reference to the accompanying drawings, wherein:

FIGS. 79 to 82 are front views of walls with optional patterns constructed with the wall blocks of FIGS. 55 to 62.

DETAILED DESCRIPTION OF THE PREFERRED EMBODIMENTS

Figure 1:
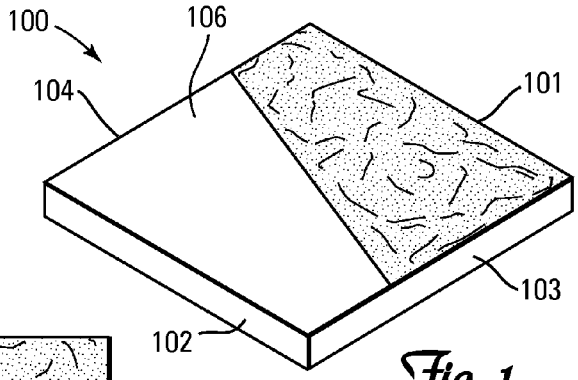
FIGS. 1 to 7 are top perspective, top, side and bottom views, respectively, of an embodiment of a landscaping block.
Figure 2:
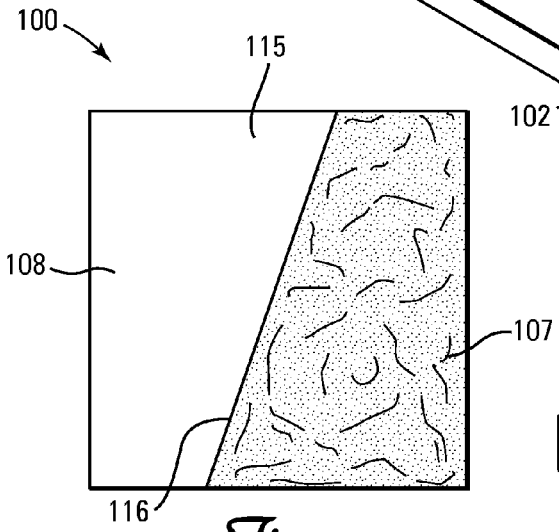
Figure 3:
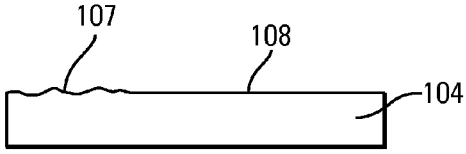
Figure 4:
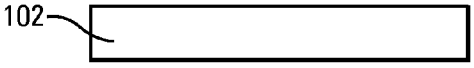
Figure 5:
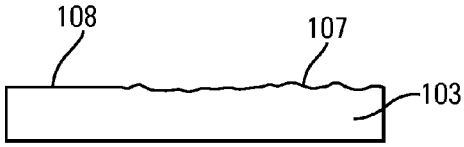
Figure 6:
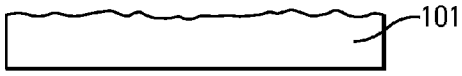
Figure 7:
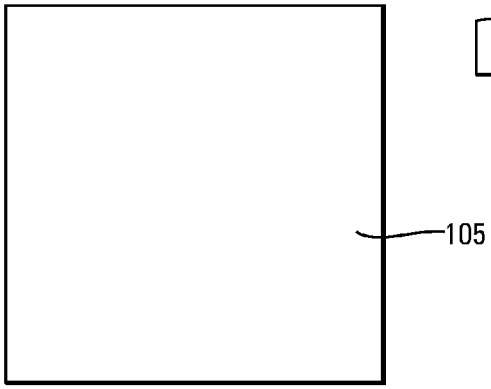

An embodiment of the landscaping or patio block is shown in FIGS. 1 to 7. Block 100 is made of a rugged, weather resistant material; preferably (and typically) zero-slump molded concrete. Other suitable materials include plastic, reinforced fibers, composite polymers, wood, metal and stone. Block 100 has a block body having parallel top surface 106 and bottom surface 105, first side surface 101, second side surface 102, third side surface 103 and fourth side surface 104. The first, second, third and fourth side surfaces, 101, 102, 103 and 104 respectively, each extend from top surface 106 to bottom surface 105. Top surface 106 has a first area 107 and a second area 108 and both are the uppermost surfaces of block 100 and may both be on the same horizontal plane. First area 107 and second area 108 combined form a total upper area 115 of block 100. Total upper area 115 may be the combined total surface areas of first area 107 and second area 108 and may also be the total surface area of top surface 106.

First area 107 is formed in a mold box with any desired first texture or pattern, and is shown in FIGS. 1 to 7 having a rough texture or a texture like that of natural stone. The pattern or texture may be formed, imparted, imprinted or applied to the mold in the mold box by a liner, a stripper shoe or any other suitable process as known in the art. The boundary of first area 107 is formed by first side surface 101, third side surface 103 and fourth side surface 104 along with division boundary 116. Division boundary 116 is angled from the third side surface 103 across top surface 106 to fourth side surface 104 and is not parallel to first and second side surfaces 101 and 102. Division boundary 116 may have any angular slope across the top surface as desired and could alternatively be 90 degrees or perpendicular to the third and fourth side surfaces and parallel to the first and second side surfaces. The first area 107 boundary extends the entire length along first side surface 101, more than half of the length along third side surface 103 and less than half the length along fourth side surface 104 creating a trapezoid shape. It should be understood that the boundary, and thus the size and shape, of first area 107 is not limiting and could extend any distance along any of the side surfaces of block 100, covering any desired proportional area of top surface 106. First area 107 could also have a boundary set back away from any or all side surfaces of block 100, covering the interior area of top surface 106 and total upper area 115.

Second area 108 is formed in a mold box with any desired second texture or pattern, the first texture or pattern of first area 107 being different than the second texture or pattern of second area 108. Further, the second texture or pattern could be a generally smooth surface which visually contrasts from the first texture or pattern. The pattern or texture may be formed, imparted, imprinted or applied to the mold in the mold box by a liner, a stripper shoe or any other suitable process as known in the art. The boundary of second area 108 is formed by second side surface 102, third side surface 103 and fourth side surface 104 along with division boundary 116. Division boundary 116 may have any angular slope across the top surface as desired and could be 90 degrees (orthogonal) or perpendicular to the third and fourth side surfaces. The second area 108 boundary extends the entire length along second surface 102, less than half of the length along third side surface 103 and more than half the length along fourth side surface 104 creating a trapezoid shape. It should be understood that the boundary, and thus the size and shape, of second area 108 is not limiting and could extend any distance along any of the side surfaces of block 100, covering any proportional area of top surface 106. Second area 108 could also have a boundary set back away from any or all side surfaces of block 100, covering the interior area of top surface 106 and total upper area 115.

Figure 8:
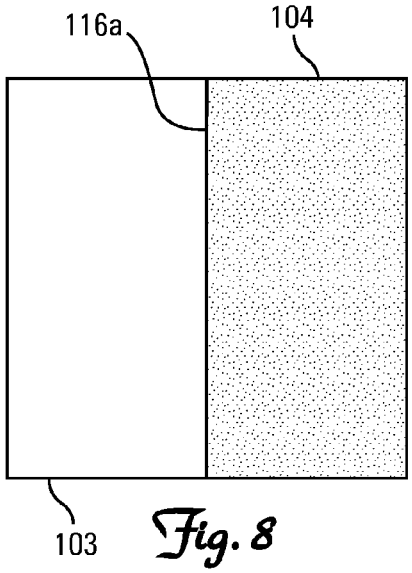
FIGS. 8 to 10 are top views of alternate division boundaries on the top surface of the block of FIGS. 1 to 7.
Figure 9:
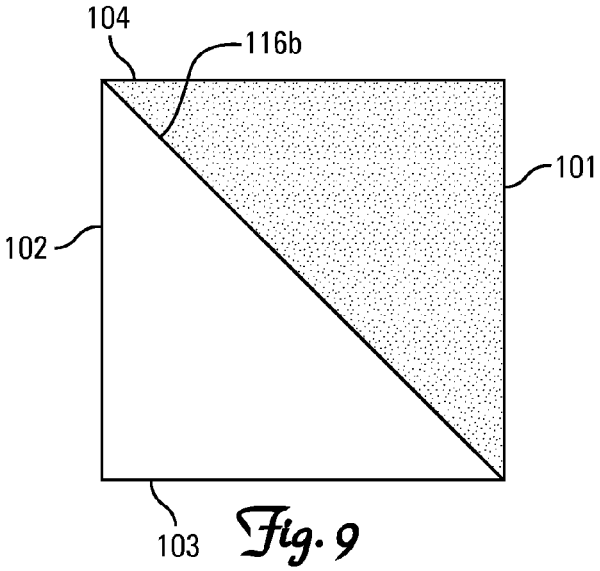
Figure 10:
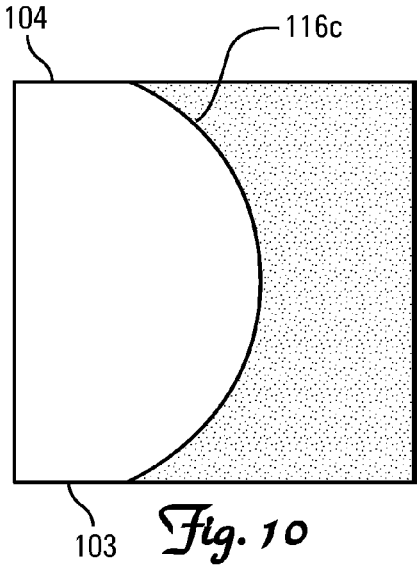

FIGS. 8 to 10 show alternate division boundaries that could separate first area 107 from second area 108. FIG. 8 shows division boundary 116*a* that is perpendicular to third side surface 103 and fourth side surface 104 and parallel to first side surface 101 and second side surface 102. FIG. 9 shows division boundary 116*b* that has a 45 degree slope from the corner where first side surface 101 abuts third side surface 103, across top surface 106 to the corner where fourth side surface 104 abuts second side surface 102. FIG. 10 shows division boundary 116*c* that is curvilinear from third side surface 103 to fourth side surface 104. It should be understood that the division boundary could be linear or could have any type of shape or curve as desired.

Figure 11:
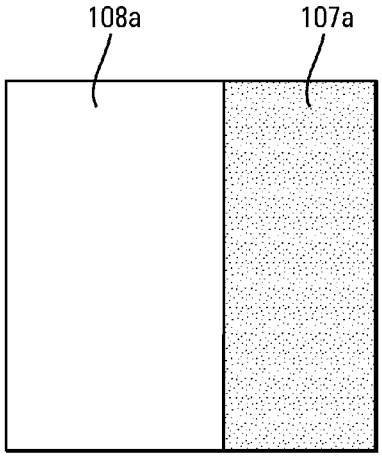
FIGS. 11 to 14 are top views of alternate proportions of first areas and second areas on the top surface of the block of FIGS. 1 to 7

First area 107 and second area 108 may be substantially equal in size, shape and surface area. Thus, first area 107 may cover around 50% of total upper area 115 and second area 108 may also cover around 50% of total upper area 115. It should be understood, however, that first area 107 and second area 108 may have any size, shape or surface area and thus the total proportion that first area 107 covers of top surface 106 (and upper area 115) could be greater than or less than 50%. Additionally, the total proportion that the second area 108 covers of top surface 106 (and upper area 115) could be greater than or less than 50%. FIGS. 11 to 14 show alternate proportions of first area 107 and second area 108 that could cover top surface 106 (and upper area 115). FIG. 11 shows first area 107*a* covering less than 50% of top surface 106 and second area 108*a* covering more than 50% of top surface 106. In this embodiment the boundary for first area 107*a* extends the entire length along first surface 101, less than half of the length along third side surface 103 and less than half the length along fourth side surface 104 with the division boundary extending across the top surface perpendicular to both the third side surface and fourth side surface, creating a rectangular shape. The boundary for second area 108*a* extends the entire length along second surface 102, more than half of the length along third side surface 103 and more than half the length along fourth side surface 104 with the division boundary extending across the top surface perpendicular to both the third side surface and fourth side surface, creating a rectangular shape.

Figure 12:
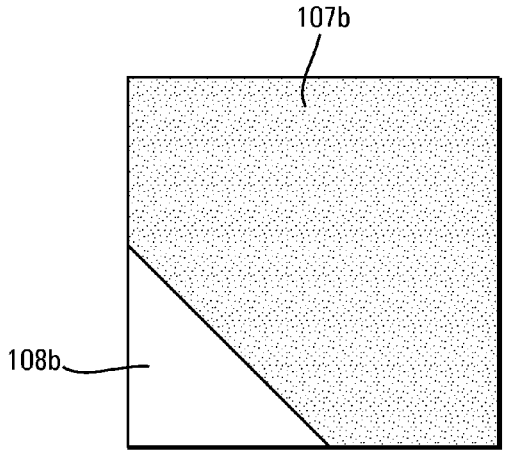

FIG. 12 shows first area 107*b* covering more than 50% of top surface 106 and second area 108*a* covering less than 50% of top surface 106. In this embodiment the boundary for first area 107*b* extends the entire length along first surface 101, the entire length along fourth surface 104, half of the length along third side surface 103 and half the length along second side surface 102 with the division boundary angularly extending across the top surface from the second side surface to the third side surface. The boundary for second area 108*b* extends half of the length along third side surface 103 and half the length along second side surface 102 with the division boundary extending across the top surface from the third side surface to the second side surface, creating a triangular shape.

Figure 13:
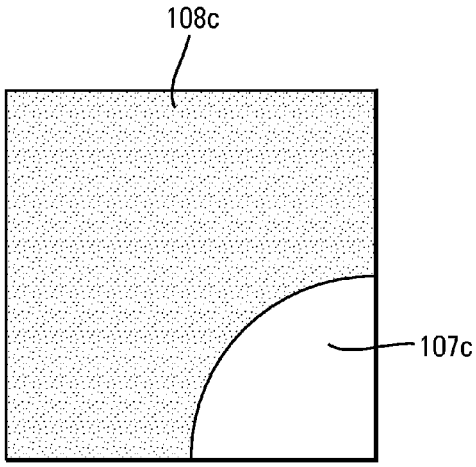

FIG. 13 shows first area 107*c* covering less than 50% of top surface 106 and second area 108*c* covering more than 50% of top surface 106. In this embodiment, the boundary for first area 107*c* extends half of the length along first side surface 101 and half the length along third side surface 103 with the division boundary extending across the top surface from the first side surface to the third side surface in a radial arc. The boundary for second area 108*c* extends the entire length along second surface 102, the entire length along fourth surface 104, half of the length along third side surface 103 and half the length along first side surface 101.

Figure 14:
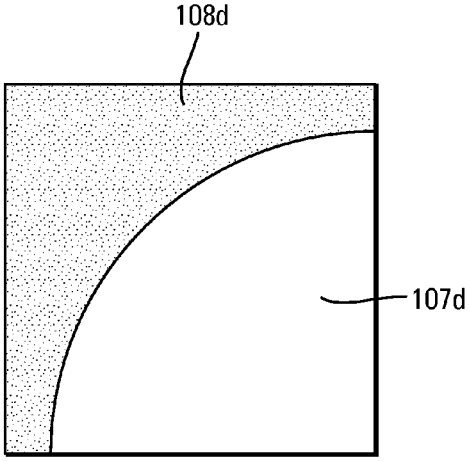

FIG. 14 shows first area 107*d* covering more than 50% of top surface 106 and second area 108*d* covering less than 50% of top surface 106. In this embodiment the boundary for first area 107*d* extends more than three-quarters of the length along third side surface 103 and more than three quarters of the length along first side surface 101 with the division boundary extending across the top surface from the first side surface to the third side surface in a radial arc. The boundary for second area 108*b* extends the entire length along second side surface 102, the entire length along fourth side surface 104, less than a quarter of the length along third side surface 103 and less than a quarter of the length along first side surface 101.

Figure 15:
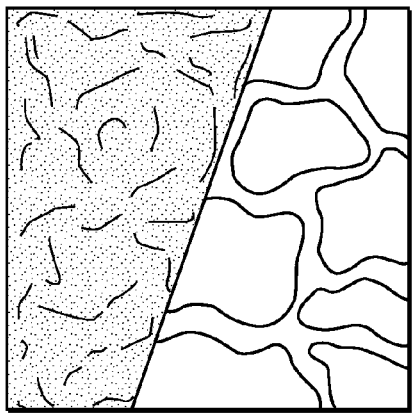
FIGS. 15 to 22 are top views of alternate pattern and texture embodiments of the block of FIGS. 1 to 7.
Figure 16:
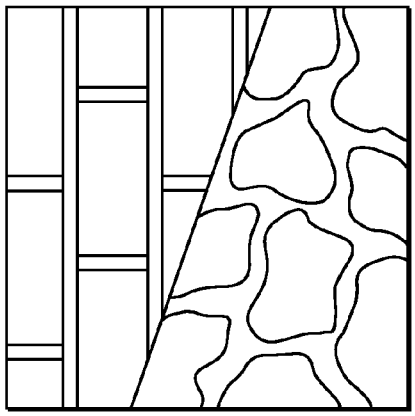
Figure 17:
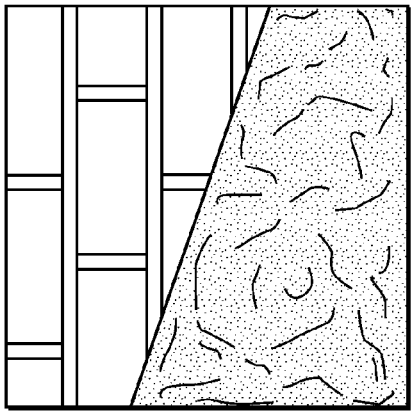
Figure 18:
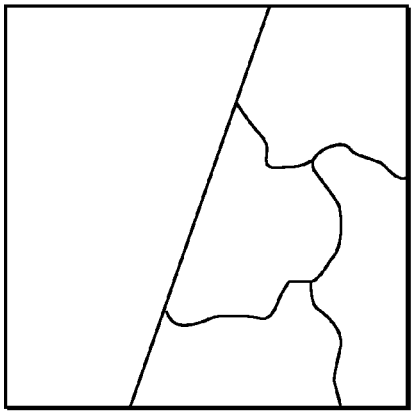

FIGS. 15 to 19 show alternate embodiments of optional patterns and textures that can be formed into the first area and second area of the landscaping block discussed above. It should be understood that the patterns and designs are not limiting and any pattern or texture could be formed into or onto the first area and second area as desired. FIG. 15 shows the first area having a natural stone pattern and the second area having a natural stone texture. FIG. 16 shows the first area having the natural stone pattern and the second area having a brick and mortar pattern. FIG. 17 shows the first area having a roughened surface texture and the second area having a brick and mortar pattern. FIG. 18 shows the first area having a flagstone pattern and the second area having a substantially smooth texture.

Figure 19:
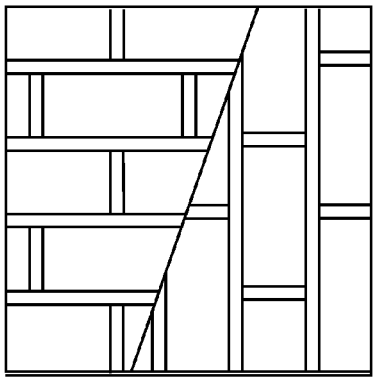

It should be understood that the first area and second area may have the same pattern when the pattern is rotated along an axis from the first area to the second area such that the rotation of the pattern creates a different aesthetic between the first and second areas such as shown in FIG. 19. FIG. 19 shows the first area having a brick and mortar pattern and the second area having the same brick and mortar pattern rotated 90 degrees.

Figure 20:
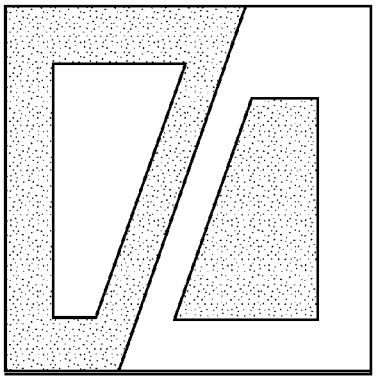

It should further be understood that the first area and second area may both have the same pattern but with different textures as in FIG. 20. FIG. 20 shows the first area and second area having the same pattern rotated 180 degrees; the first area has the inner trapezoid with a roughened texture while the outer trapezoid has a substantially smooth texture; and the second area has the inner trapezoid with a substantially smooth texture while the outer trapezoid has a roughened texture.

Figure 21:
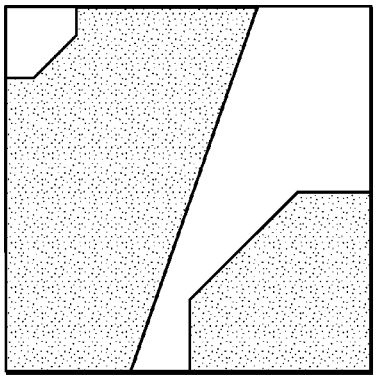
Figure 22:
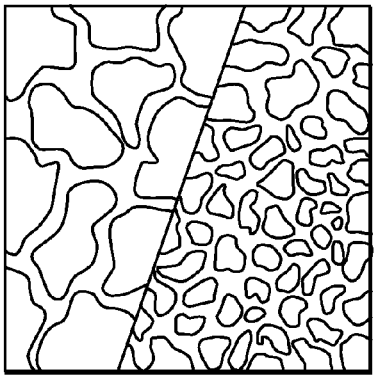

It should still be further understood that the first and second area could have the same pattern with different proportions or sizes in each of the first and second areas as shown in FIG. 21. FIG. 21 shown the first area having a large partial hexagon shaped pattern with a substantially smooth texture and the second area having a much smaller partial hexagon shaped pattern with a roughened texture. FIG. 22 shows the first area having a natural small stone pattern and the second area having a natural larger stone pattern.

Figure 23:
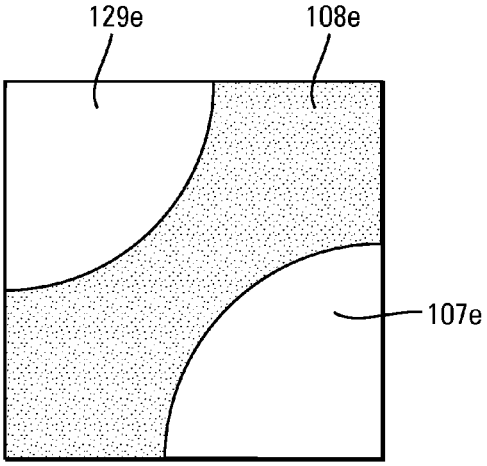
FIGS. 23 to 26 are top views of alternative top surfaces of the blocks of FIGS. 1 to 7 with more than a first area and a second area.
Figure 24:
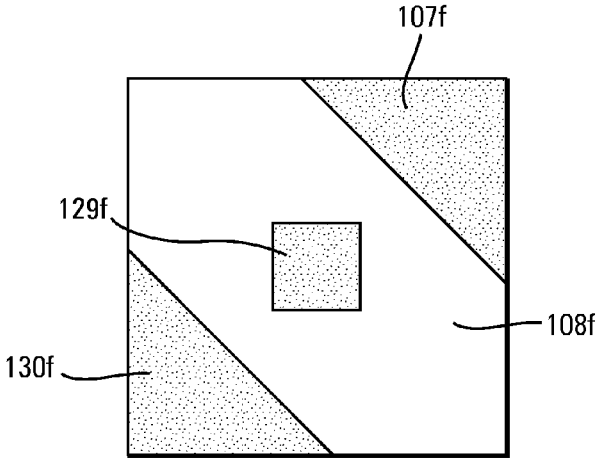
Figure 25:
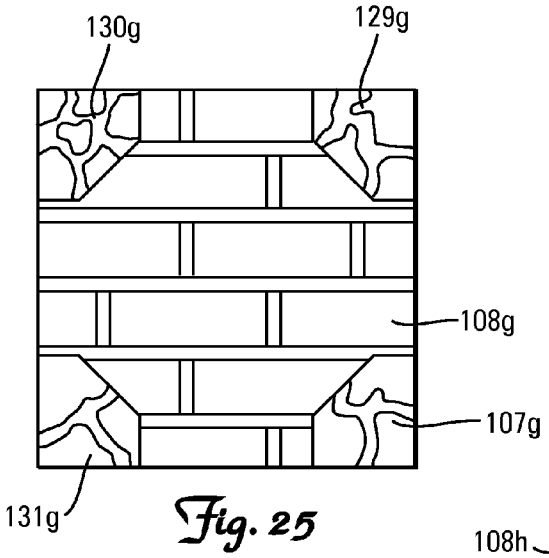
Figure 26:
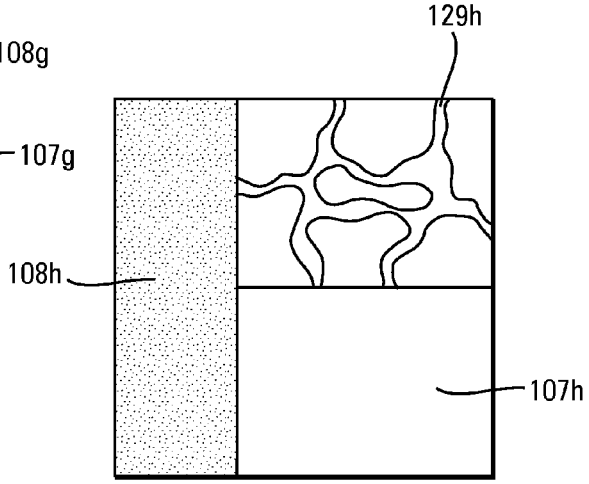

FIGS. 23 to 26 show alternate embodiments of the landscaping block with more than two areas, covering similar and different proportional areas of top surface 106 and total upper area 115. It should be understood that the patterns and designs are not limiting and any pattern or texture could be formed into or onto any of the areas as desired. FIG. 23 shows an embodiment of the landscaping block with a first area 107*e*, a second area 108*e* and a third area 129*e*. FIG. 24 shows an embodiment of the landscaping block with a first area 107*f*, a second area 108*f*, a third area 129*f* and a fourth area 130*f*. FIG. 25 shows an embodiment of the landscaping block with a first area 107*g*, a second area 108*g*, a third area 129*g*, a fourth area 130*g* and a fifth area 131*g*. FIG. 26 shows an embodiment of the landscaping block with a first area 107*h*, a second area 108*h* and a third area 129*h*.

Though the blocks illustrated above may have various dimensions, block 100 may have a height (i.e., the distance between surfaces 106 and 105) of about 2 inches (51 mm), a body length (i.e., the distance from side surface 101 to side surface 102) of about 16 inches (406 mm) and a width (i.e., the distance from side surface 103 to side surface 104) of about 16 inches (406 mm). It should be understood that these dimensions are not limiting and the landscaping or patio block may have any dimensions as desired.

FIGS. 27 to 31 show patios and portions of patios constructed from the blocks of FIGS. 1 to 7 wherein the blocks of each patio or portion of a patio are positioned to create a repeating geometric pattern in the patio using the different textured or patterned first area 107 and different textured or patterned second area 108 of each block 100. It should be understood that that any of the following patios or portions of patios may be constructed from any or all of the embodiments of blocks described above, including blocks with different area proportions, alternate embodiments of patterns and textures, different shaped areas utilizing alternate division boundaries, and blocks having more than a first area and second area on the top surface. Generally, when constructing a patio, the desired dimensioned area of the patio is excavated to a pre-selected depth and partially filled with a level base of granular material such as crushed stone or sand and is then tampered. The patio blocks are then placed and leveled onto the granular material. The blocks are placed side to side with top surface 106 facing upward and the bottom surface 105 facing downward.

Figure 27:
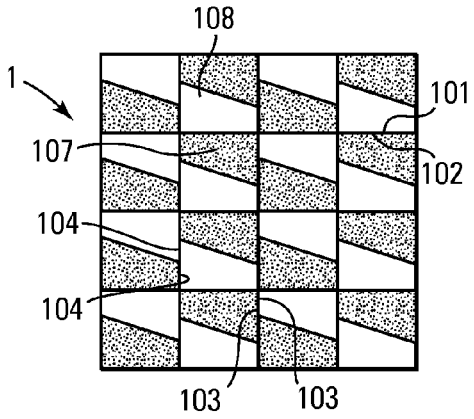
FIGS. 27 to 31 are top views of patios with optional patterns constructed with the landscaping blocks of FIGS. 1 to 7.

FIG. 27 shows patio 1 wherein patio block 100 is positioned such that the first area 107 of one patio block is directly adjacent the second area 108 of an adjacent patio block (and vice versa) and such that side surface 101 of one patio block is directly adjacent side surface 102 of an adjacent patio block. Additionally, patio block 100 is positioned such that the third side surface 103 of one patio block is directly adjacent third side surface 103 of an adjacent patio block 100 and fourth side surface 104 is directly adjacent fourth side surface 104 of an adjacent patio block 100.

Figure 28:
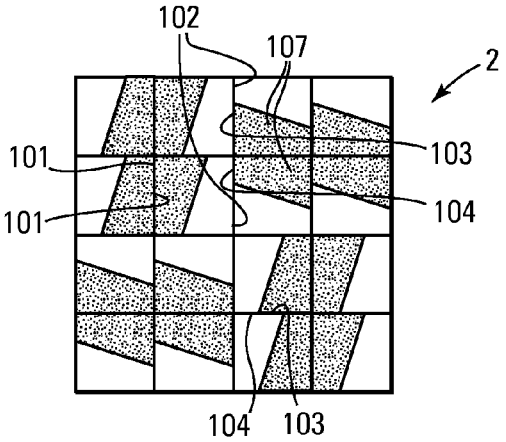

FIG. 28 shows patio 2 wherein patio block 100 is positioned such that the first area 107 of one patio block is directly adjacent the first area 107 of an adjacent patio block and such that first side surface 101 of one patio block is directly adjacent first side surface 101 of another patio block. Additionally, patio block 100 may be positioned such that third side surface 103 of one patio block may be directly adjacent fourth side surface 104 or second side surface 102 of an adjacent patio block. Patio block 100 may also be positioned such that fourth side surface 104 may be directly adjacent side surface 103 or second side surface 102.

Figure 29:
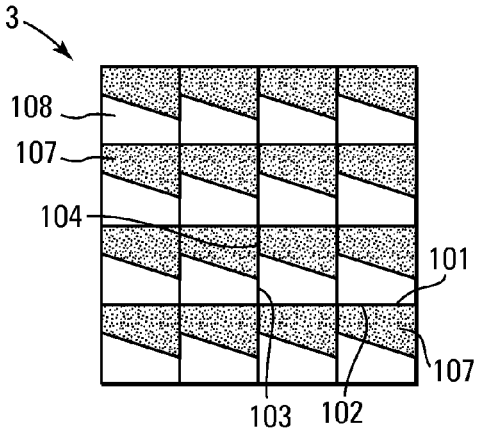

FIG. 29 shows patio 3 wherein patio block 100 is positioned such that the first area 107 of one patio block is directly adjacent the second area 108 of an adjacent patio block (and vice versa) and such that side surface 101 of one patio block is directly adjacent side surface 102 of an adjacent patio block. Additionally, patio block 100 is positioned such that the third side surface 103 of one patio block is directly adjacent fourth side surface 104 of an adjacent patio block 100 (and vice versa).

Figure 30:
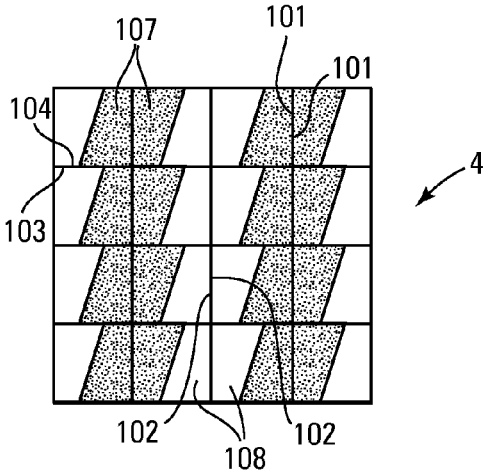

FIG. 30 shows patio 4 wherein patio block 100 is positioned such that the first area 107 of one patio block is directly adjacent the first area 107 of an adjacent patio block and such that first side surface 101 of one patio block is directly adjacent first side surface 101 of another patio block. Additionally, patio block 100 is positioned such that third side surface 103 of one patio block is directly adjacent fourth side surface 104 of an adjacent patio block. Patio block 100 is also positioned such that second area 108 of one patio block is directly adjacent second area 108 of a second adjacent patio block.

Figure 31:
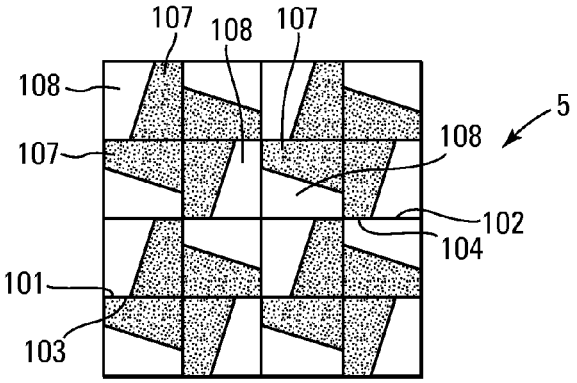

FIG. 31 shows patio 5 wherein patio block 100 is positioned such that first side surface 101 of one patio block 100 is directly adjacent third side surface 103 of an adjacent patio block 100 and such that first area 107 of one block is directly adjacent the third side surface (the first and second area) of an adjacent block. Additionally, patio block 100 is positioned such that second side surface 102 of one patio block 100 is directly adjacent fourth side surface 104 of an adjacent patio block 100 and such that the second area 108 of one block is directly adjacent to the fourth side surface (the first and second area) of an adjacent block.

FIGS. 32 to 38 show patios and portions of patios constructed from multiple sizes of the blocks of FIGS. 1 to 7 wherein the blocks of each patio or portion of a patio are positioned to create a repeating geometric pattern in the patio using the different textured or patterned first area 107 and different textured or patterned second area 108 of each of the multiple sized blocks. Patio block 100 and patio block 200 are substantially similar except that the length of the side surfaces of block 200 are half the length of the side surfaces of block 100. It should be understood that the size of the patio blocks are not limiting and any combination of sized patio blocks may be used for the construction of a patio. Further, the pattern or texture of the patio blocks are not limiting and the patio may be constructed from patio blocks with different patterns or textures from one block type to the next. Still further yet, the shape of the patio blocks are not limiting and the patio constructed from the patio blocks may be different from one block type to another such that some patio blocks may be square and some patio blocks may be rectangular or any other desired shape.

Figure 32:
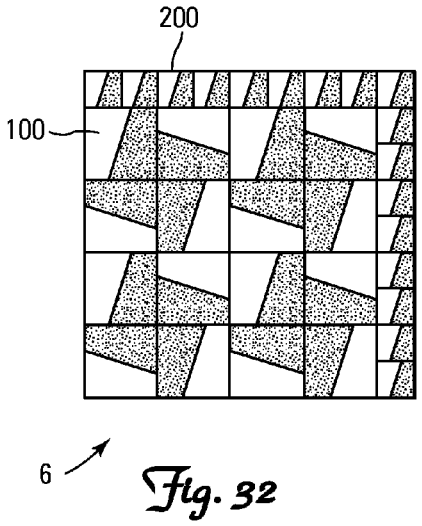
FIGS. 32 to 38 are top views of patios with optional patterns constructed with first and second sized landscaping blocks of FIGS. 1 to 7.
Figure 33:
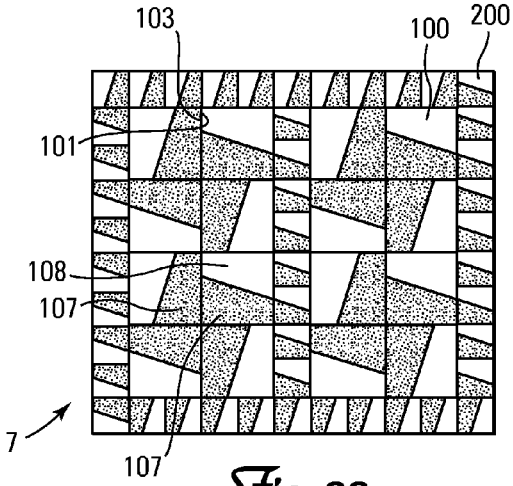

FIG. 32 shows patio portion 6 which is substantially similar to patio 5 of FIG. 26 except that patio block 200 has been used to border the perimeter around patio block 100. FIG. 33 shows patio 7 which is constructed from four patio blocks 100 positioned such that first side surface 101 of one patio block 100 is directly adjacent third side surface 103 of an adjacent patio block 100 and such that first area 107 of one block is directly adjacent the third side surface (the first and second area) of an adjacent block. Patio blocks 200 are then positioned around a portion or all of the perimeter of the four patio blocks 100. The placement of the four patio blocks 100 and the perimeter border blocks 200 are then repeated as desired.

Figure 34:
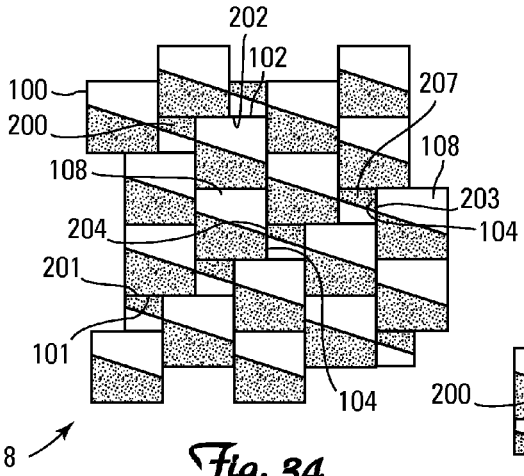

FIG. 34 shows patio portion 8 and is constructed from patio blocks 100 and 200. Patio blocks 200 may be positioned in a repeating pattern such that there are 4 individual patio blocks 100 adjacent to the side surfaces of patio block 200 and that there are two patio blocks 200 adjacent to every patio block 100. Patio blocks 100 may be positioned in a repeating pattern such that there are five individual patio blocks 100 offset around each patio block 100. Patio block 200 is further placed such that the first area portion 207 of third side surface 203 is placed directly adjacent to the second area portion 108 of the third side surface 103 of adjacent block 100. First side surface 201 of patio block 200 is positioned directly adjacent to the first side surface 101 of a second adjacent patio block 100. Additionally, patio block 200 is placed such that second area portion 208 of fourth side surface 204 is placed directly adjacent to the first area portion 107 of the fourth side surface 104 of a third adjacent block 100 and block 200 is positioned such that second side surface 202 is directly adjacent to the second side surface 102 of a fourth adjacent patio block 100.

Figure 35:
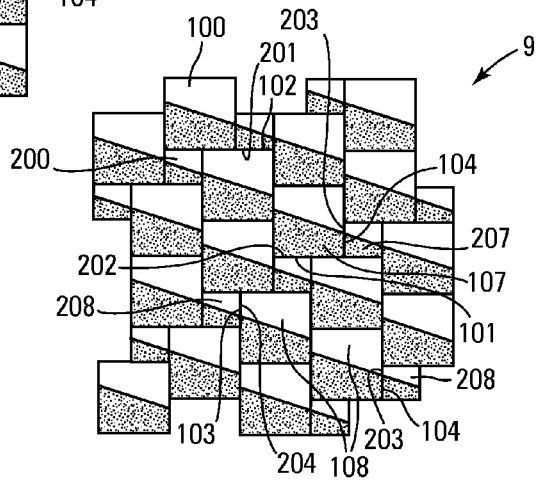

FIG. 35 shows patio portion 9 and is constructed from patio blocks 100 and 200. Patio blocks 200 may be positioned in a repeating pattern such that there are 4 individual patio blocks 100 adjacent to the side surfaces of patio block 200 and that there are two patio blocks 200 adjacent to every patio block 100. Patio blocks 100 may be positioned in a repeating pattern such that there are four individual patio blocks 100 offset around each patio block 100 and one individual patio block 100 placed directly adjacent each patio block 100. Patio block 200 is further placed such that first area portion 207 of third side surface 203 is placed directly adjacent to the first area portion 107 of the fourth side surface 104 of adjacent block 100. First side surface 201 of patio block 200 is positioned directly adjacent to the second side surface 102 of a second adjacent patio block 100. Additionally, patio block 200 is placed such that second area portion 208 of fourth side surface 204 is placed directly adjacent to the second area portion 108 of the third side surface 103 of a third adjacent block 100 and block 200 is positioned such that second side surface 202 is directly adjacent to the first side surface 101 of a fourth adjacent patio block 100.

Figure 36:
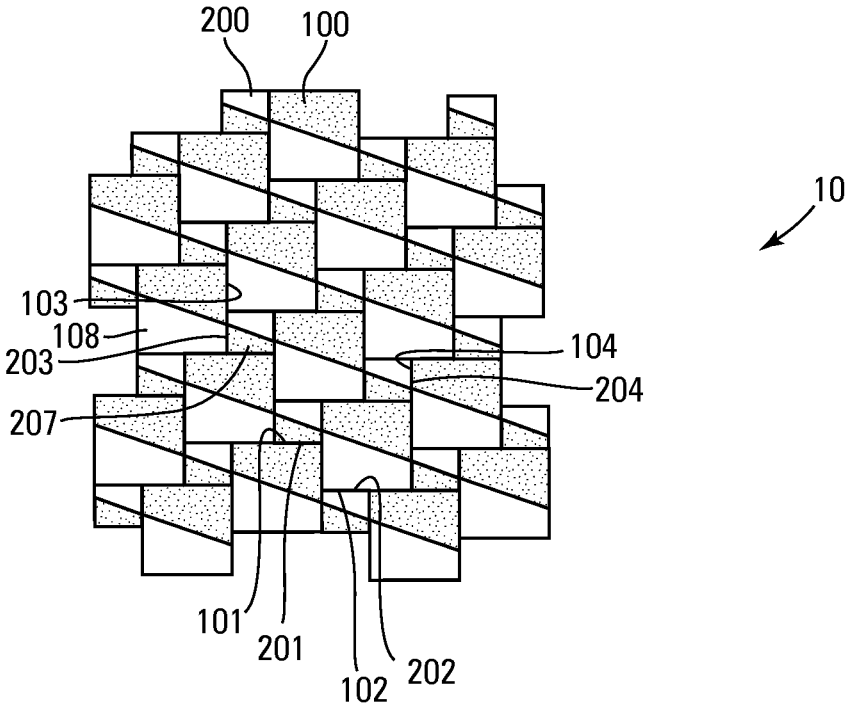

FIG. 36 shows patio 10 and is constructed from patio blocks 100 and 200. Patio blocks 200 may be positioned in a repeating pattern such that there are four individual patio blocks 100 adjacent to the side surfaces of patio block 200 and that there are four patio blocks 200 adjacent to every patio block 100. Patio blocks 100 may be positioned in a repeating pattern such that there are four individual patio blocks 100 offset around each patio block 100. Patio block 200 is further placed such that the first area 207 portion of third side surface 203 is placed directly adjacent to the second area 108 portion of the third side surface 103 of adjacent block 100. First side surface 201 of patio block 200 is positioned directly adjacent to the first side surface 101 of a second adjacent patio block 100. Additionally, patio block 200 is placed such that second area 208 portion of fourth side surface 204 is placed directly adjacent to the first area portion 107 of the fourth side surface 104 of a third adjacent block 100 and block 200 is positioned such that second side surface 202 is directly adjacent to the second side surface 102 of a fourth adjacent patio block 100.

Figure 37:
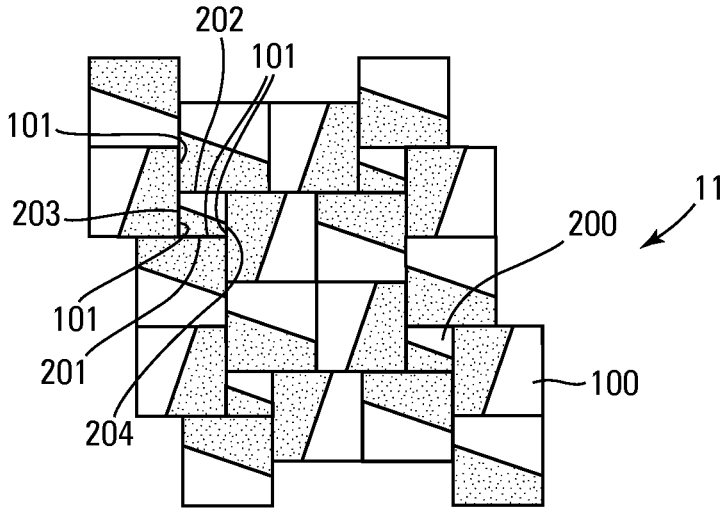
Figure 38:
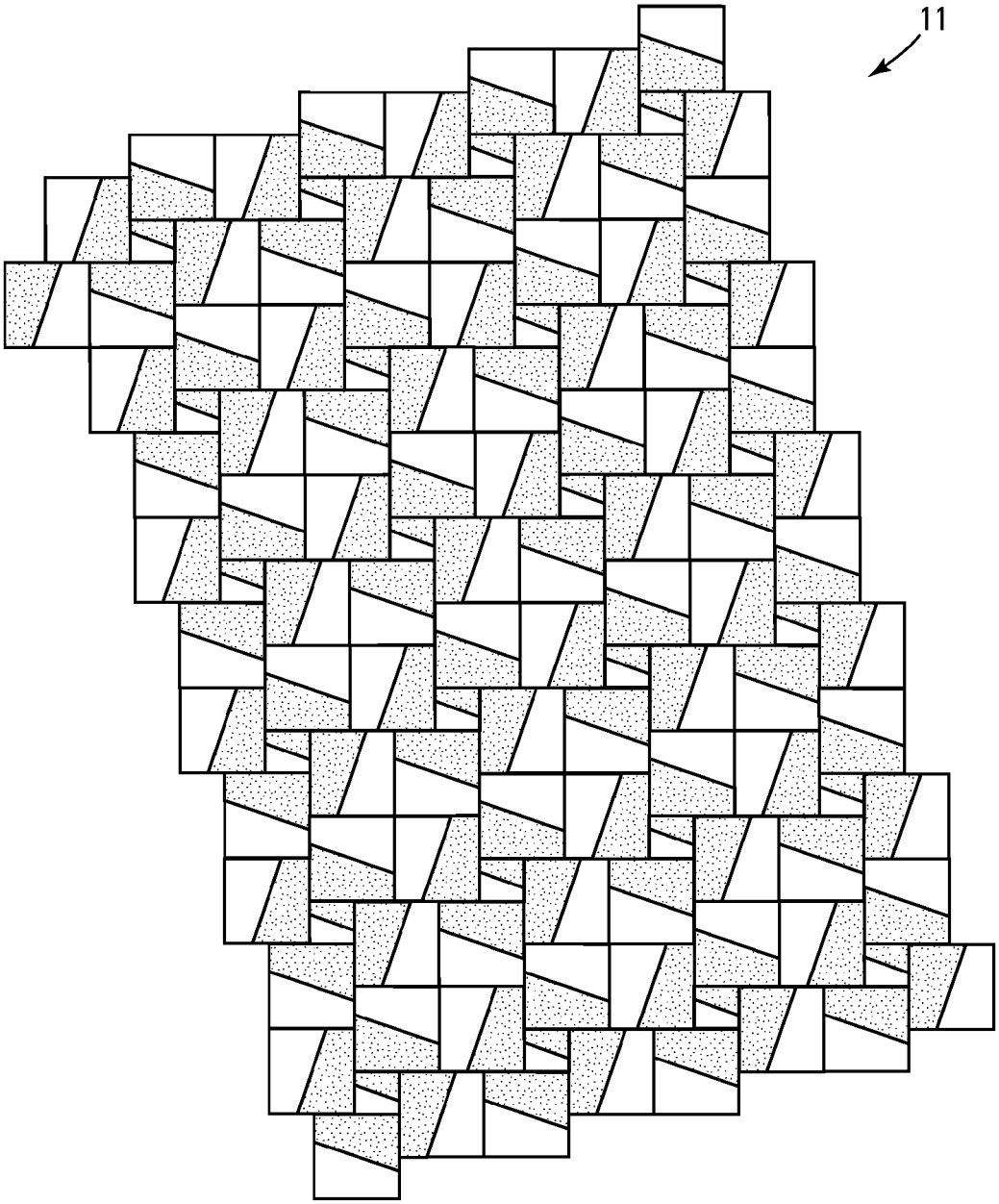

FIGS. 37 and 38 show patio portion 11 and is constructed from patio blocks 100 and 200. Patio blocks 200 may be positioned in a repeating pattern such that there are four individual patio blocks 100 adjacent to the side surfaces of patio block 200 and that there is one patio block 200 adjacent to every patio block 100. Patio blocks 100 may be positioned in a repeating pattern such that there are 3 individual patio blocks offset around each patio block 100 and two individual patio block s100 placed directly adjacent each patio block 100. Patio block 200 is positioned such that the first side surface 201, second side surface 202, third side surface 203 and fourth side surfaces 204 of patio block 200 are directly adjacent side surface 101 of the four individual patio blocks 100 surrounding patio block 200.

Figure 39:
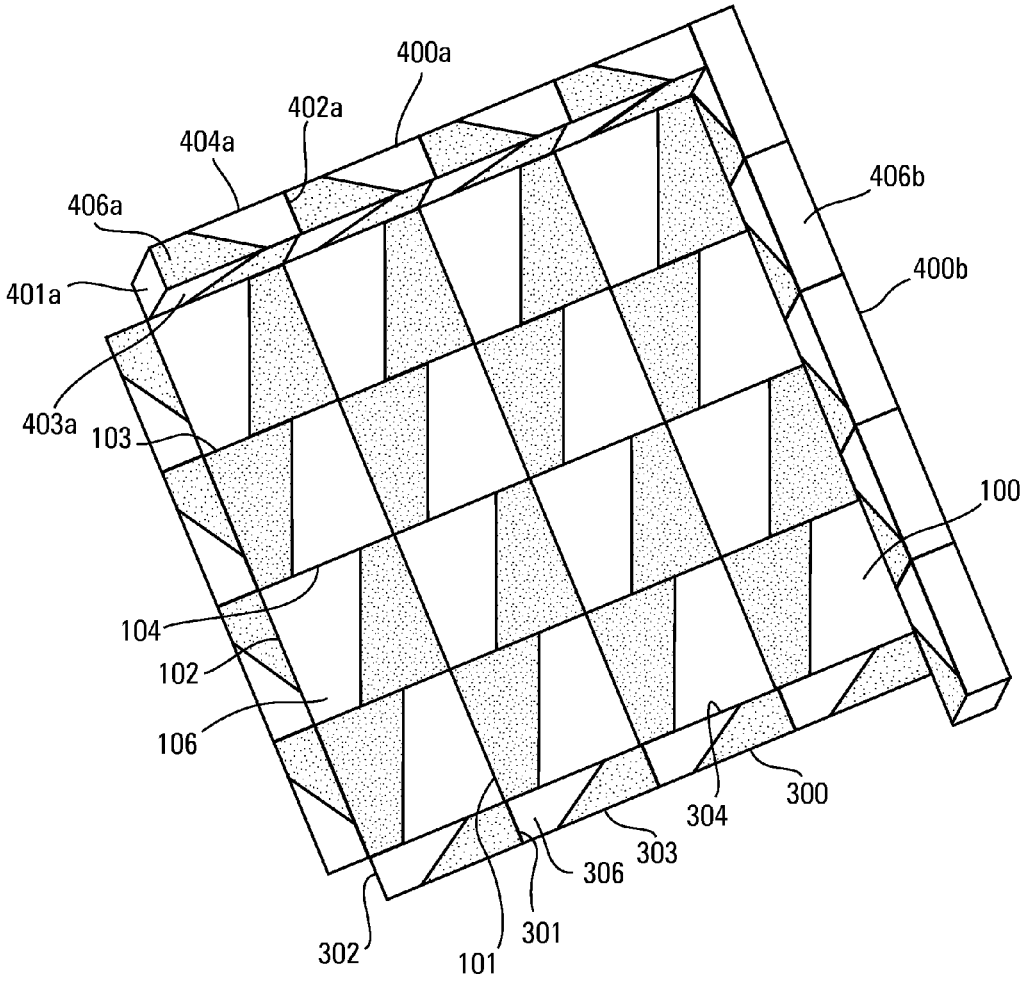
FIG. 39 is a front perspective view of an alternate embodiment of a patio constructed with the landscaping blocks of FIGS. 1 to 7, an alternate embodiment of a landscaping block and first and second embodiments of an edger block.
Figure 40:
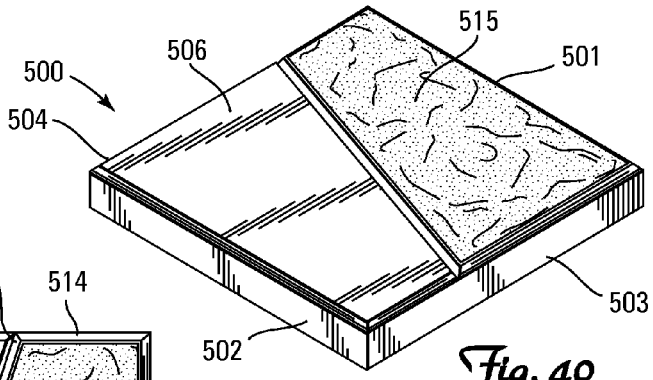
FIGS. 40 to 46 are top perspective, top, side and bottom views, respectively, of an alternate embodiment of a landscaping block.
Figure 41:
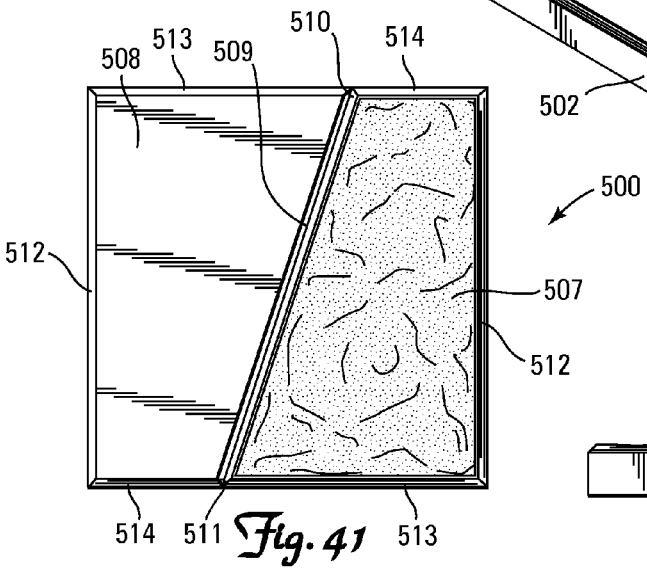
Figure 42:
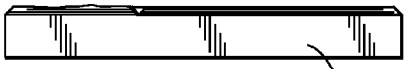
Figure 43:
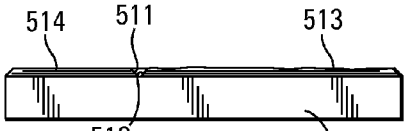
Figure 44:
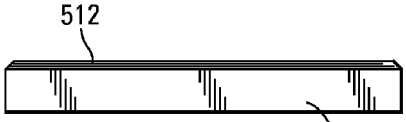
Figure 45:
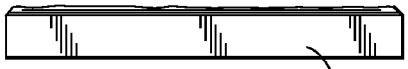
Figure 46:
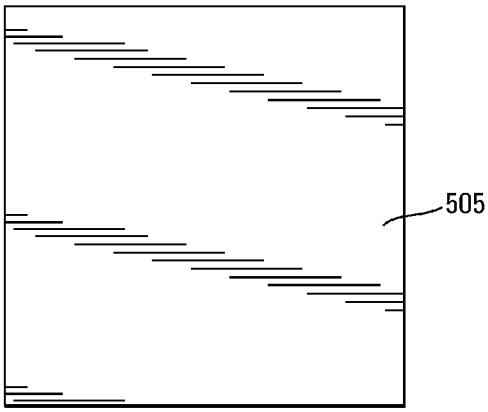

FIG. 39 shows a patio constructed from the patio blocks of FIGS. 1 to 7, alternate patio block 300 and edger blocks 400*a* and 400*b*. The patio constructed from blocks 100 is substantially similar to patio 1 described above. Two sides of the patio have been bordered with block 300 which is substantially similar to block 100 except that side surfaces 301 and 302 of block 300 are less than the length of side surfaces 101 and 102 of block 100 and may be about 25% of the length of side surfaces 101 and 102. Side surfaces 303 and 304 of block 300 are substantially similar in size to side surfaces 103 and 104 of block 100. Two sides of the patio have been bordered with edger blocks 400*a* and 400*b*. Edger block 400*a* is similar to block 300 except that the height of side surfaces 401*a*, 402*a*, 403*a* and 404*a* is greater than that of the height of the side surfaces of block 300. Additionally side surface 403*a* and 404*a* have also been given a first and second area with different patterns or textures as in top surface 406*a*, top surface 306 of block 300 and top surface 106 of block 100. Edger block 400*b* is similar to edger block 400*a* except that top surface 406*b* does not have a first area and second area with different textures or patterns.

FIGS. 40 to 46 show an alternate embodiment of the landscaping or patio block shown in FIGS. 1 to 22. Block 500 may be made of a rugged, weather resistant material; preferably (and typically) zero-slump molded concrete. Other suitable materials include plastic, reinforced fibers, composite polymers, wood, metal and stone. Block 500 has a block body having parallel top surface 506 and bottom surface 505, first side surface 501, second side surface 502, third side surface 503 and fourth side surface 504. The first, second, third and fourth side surfaces, 501, 502, 503 and 504 respectively, each extend from top surface 506 to bottom surface 505. Top surface 506 may have angled surfaces or bevels 512 which are non-orthogonal to side walls 501 and 502 and angled surfaces or bevels 513 and 514 which are non-orthogonal to side surfaces 503 and 504. Angular surfaces 513 on side surfaces 503 and 504 have the same length and angular surfaces 514 on side surfaces 503 and 504 have the same length. Angled surfaces or bevels 512, 513 and 514 may have any angular degree of slope or convergence as desired and may be greater than 90° from a vertical plane formed by side surfaces 501, 502, 503 and 504. For example, angled surface 512 may be sloped at a 45 degree angle from top surface 506 so that it forms an angle of 135 degrees with respect to side surfaces 501, 502, 503 or 504.

Top surface 506 has a first area 507 and a second area 508 and both are the uppermost surfaces of block 500. First area 507 and second area 508 are on the same horizontal plane and form a total upper area 515 of block 500. First area 507 may be bordered by bevels or angular surfaces 510, 512, 513 and 514 and second area 508 may be bordered by bevels or angular surfaces 511, 512, 513 and 514. Top surface 506 may also have recessed surface or recessed division boundary 509 that separates first area 507 and second area 508. First area 507 may be formed with a rough texture or a texture like that of natural stone and second area 508 may be formed with a substantially smooth texture. First area 507 and second area 508 may have any desired size or shape and combined may form the total surface area of total upper area 515. First area 507, second area 508, angular surfaces 510, 511, 512, 513 and 514 along with the recessed surface of division boundary 509 may form the total surface area of top surface 506.

First area 507 is formed in a mold box with any desired first texture or pattern. The pattern or texture may be formed, imparted, imprinted or applied to the mold in the mold box by a liner, a stripper shoe or any other suitable process as known in the art. The boundary of first area 507 is formed by angular surface 512 and first side surface 501, angular surface 513 and third side surface 503 and angular surface and fourth side surface 504 along with angular surface 510 and recessed surface or division boundary 509. Recessed surface or division boundary 509 is angled from the third side surface 503 across top surface 506 to fourth side surface 504. Recessed surfaces or division boundary 509 may have any angular slope across top surface 506 from third side surface 503 to fourth side surface 504 as desired and could be 90 degrees or perpendicular to the third and fourth side surfaces. It should be understood that the boundary, and thus the size and shape, of first area 507 is not limiting and could extend any distance along any of the side surfaces of block 500, covering any desired proportional area of top surface 506. Additionally, the angular surfaces could also extend any distance along the side surfaces as desired. Further, it should be understood that only one of the first area or second area could be bordered by angular surfaces. It should also be understood that first area 507 and angular surfaces 510, 512, 513 and 514 may have the same texture or pattern or may have different textures or patterns as desired.

Second area 508 is formed in a mold box with any desired second texture or pattern, the first texture or pattern of first area 507 being different than the second texture or pattern of second area 508. The pattern or texture may be formed, imparted, imprinted or applied to the mold in the mold box by a liner, a stripper shoe or any other suitable process as known in the art. The boundary of second area 508 is formed by angular surface 512 and second side surface 502, angular surface 514 and third side surface 503 and angular surface 513 and fourth side surface 504 along with angular surface 511 and recessed surface or division boundary 509. It should be understood that the boundary, and thus the size and shape, of second area 508 is not limiting and could extend any distance along any of the side surfaces of block 500, covering any proportional area of top surface 506. Additionally, the angular surfaces could also extend any distance along the side surfaces as desired. It should also be understood that second area 508 and angular surfaces 511, 512, 513 and 514 may have the same texture or pattern or may have different textures or patterns as desired.

FIGS. 47 to 51 show an alternate embodiment of the landscaping or patio block. Block 600 is made of a rugged, weather resistant material; preferably (and typically) zero-slump molded concrete. Other suitable materials include plastic, reinforced fibers, composite polymers, wood, metal and stone. Block 600 has a block body having parallel top surface 606 and bottom surface 605, first side surface 601, second side surface 602, third side surface 603 and fourth side surface 604. The first, second, third and fourth side surfaces, 601, 602, 603 and 604 respectively, each extend from top surface 606 to bottom surface 605. Top surface 606 has a first area 607 and a second area 608 and both are the uppermost surfaces of block 600 and may both be on the same horizontal plane or first area 607 may be on one or more incline planes and second area 608 may be on a horizontal plane. First area 607 and second area 608 combined form a total upper area 615 of block 600. Total upper area 615 may be the combined total surface areas of first area 607 and second area 608 and may also be the total surface area of top surface 606.

Figure 47:
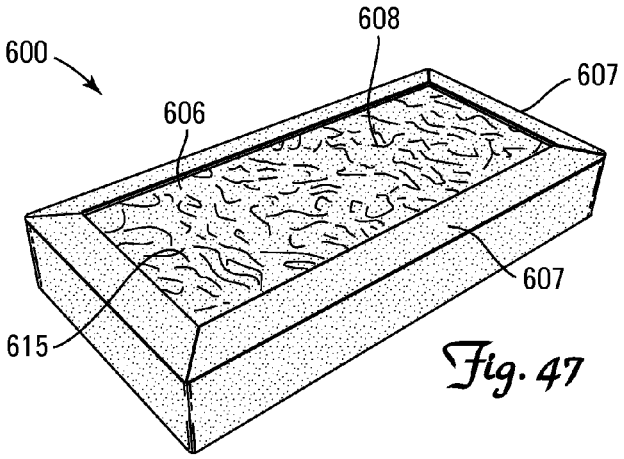
FIGS. 47 to 51 are top perspective, top, side and bottom, views, respectively, of an alternate embodiment of a landscaping block.
Figure 48:
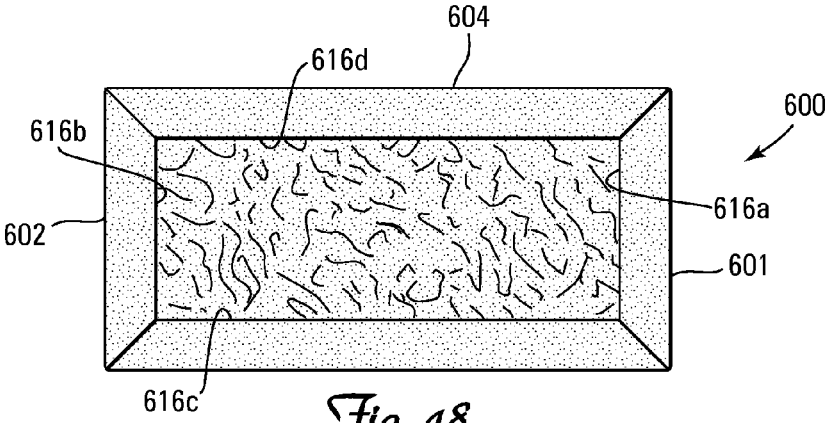
Figure 49:
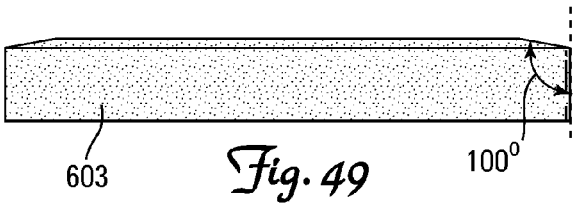
Figure 50:
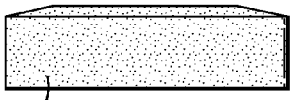
Figure 51:
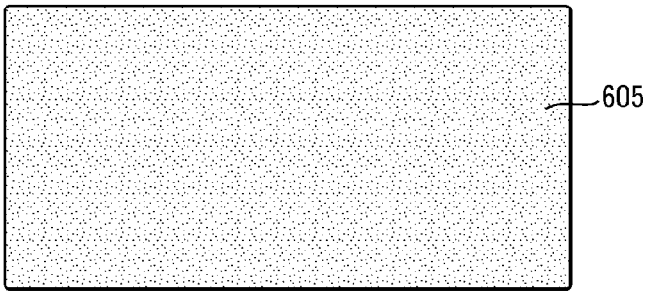

First area 607 is formed in a mold box with any desired first texture or pattern, and is shown in FIGS. 47 and 48 having a substantially smooth texture. The pattern or texture may be formed, imparted, imprinted or applied to the mold in the mold box by a liner, a stripper shoe or any other suitable process as known in the art. The boundary of first area 607 is formed by first side surface 601, second side surface 602, third side surface 603 and fourth side surface 604 along with division boundary 616*a*, 616*b*, 616*c* and 616*d*. Division boundary 616*a* is parallel to first side surface 601, division boundary 616*b* is parallel to second side surface 602, division boundary 616*c* is parallel to third side surface 603 and division boundary 616*d* is parallel to fourth side surface 604. First area 607 can be on the same horizontal plane as second area 608. As seen in FIGS. 47 to 50 first area 607 can also be on multiple incline planes. The incline planes of first area 607 may have any angular degree of slope or convergence as desired and may be greater than 90° from a vertical plane formed by side surfaces 601, 602, 603 and 604. The portion of first area 607 adjacent first side surface 601 may be sloped at an 80 degree angle from division boundary 616*a* and second area 608 such that it forms an angle of 100 degrees with respect to side surfaces 601 as seen in FIG. 49. Thus, the slope or degree of incline of the portion of the first area adjacent first side surface 601 may be 10 degrees. The slope or degree of incline may be the same for the portions of first area 607 adjacent side surface 602, side surface 603 and side surface 604. Optionally each portion of first area 607 may have varying degrees of incline. It should be understood that the boundary, and thus the size and shape, of first area 607 is not limiting and could extend any distance along any of the side surfaces of block 600, covering any desired proportional area of top surface 606.

Second area 608 is formed in a mold box with any desired second texture or pattern, the first texture or pattern of first area 607 being different than the second texture or pattern of second area 608. The pattern or texture may be formed, imparted, imprinted or applied to the mold in the mold box by a liner, a stripper shoe or any other suitable process as known in the art. The boundary of second area 108 is formed by division boundaries 616*a*, 616*b*, 616*c* and 616*d*. The second area 608 boundaries extends a portion of the length of second surface 602, a portion of the length of first surface 601, a portion of the length of third surface 603 and a portion of the length of fourth surface 604. It should be understood that the boundary, and thus the size and shape, of second area 608 is not limiting and could extend any length of the side surfaces of block 600, covering any proportional area of top surface 606.

Figure 52:
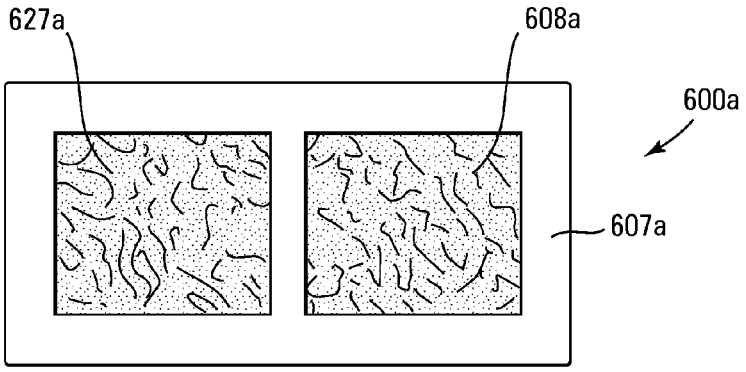
FIGS. 52 to 54 are top views of alternate patterns, sizes and shapes of the top surface of the block of FIGS. 47 to 51.
Figure 53:
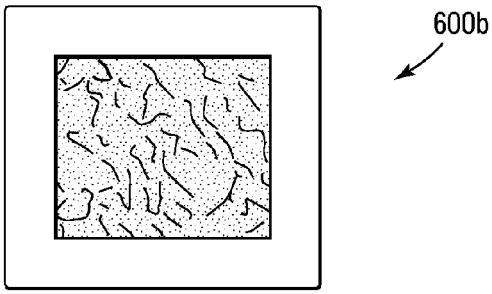
Figure 54:
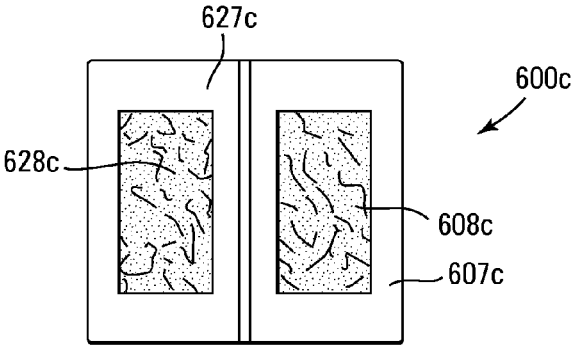

FIG. 52 shows an alternate embodiment of the landscaping block of FIGS. 47 to 51. Wall block 600*a* has a first area 607*a*, a second area 608*a* and a third area 627*a*. FIG. 53 shows an alternate embodiment of the landscaping block of FIGS. 47 to 51. Wall block 600*b* is substantially similar to wall block 600 except that wall block 600*b* has been molded with a square shape. FIG. 54 shows an alternate embodiment of the landscaping block of FIG. 53. Wall block 600*c* is substantially similar to wall block 600*b* except that wall block 600*c* has first area 607*c*, second area 608*c*, third area 627*c* and fourth area 628*c*.

An embodiment of a wall block is shown in FIGS. 55 to 62. Wall block 700 is made of a rugged, weather resistant material; preferably (and typically) zero-slump molded concrete. Other suitable materials include plastic, reinforced fibers, composite polymers, wood, metal and stone. Block 700 has a block body having parallel top surface 706 and bottom surface 705, front face 703, rear face 704 and first and second side walls 701 and 702. Front face 703 and rear face 704 each extend from top face 706 to bottom face 705. Side walls 701 and 702 extend from top surface 706 to bottom surface 705, converging from front face 703 toward rear face 704. It should be understood that block 700 is not limiting and that block 700 could have any desired shape, size or any features as desired.

Block 700 may include openings or cores 714 and 715 that may extend from top surface 706 to bottom surface 705, or may only extend partially through block 700, i.e., open to top surface 706 but closed at bottom surface 705. Cores 714 and 715 reduce the weight of block 700. Lower block weight is both a manufacturing advantage and a constructional advantage when building a wall from the wall blocks as it reduces cost due to less material and makes lifting of the blocks easier. Block 700 may have first and second pin holes 718, extending through block 700; open to top surface 706 and bottom surface 705. It should be understood that this is not limiting and that block 700 can be manufactured with the pin holes extending from top surfaces 706 through any desired distance toward bottom surface 705, i.e., open to the top surface but not open to the bottom surface. Further pin holes 718 may be manufactured to open into any surface of core 715 and/or any surface of core 714 or may be manufactured to be closed to both cores. Block 700 may also be manufactured without any pin holes. The pin hole interior surfaces may be tapered from wider to narrower from the top surface to the bottom surface or its interior surfaces may be non-tapered or plumb. This taper of the surfaces of the pin holes is used in the manufacturing phase to help ease the removal of the block unit from the mold.

Pin holes are sized to receive a pin having a shaft which is placed into a pin hole in a lower course of blocks when constructing a wall. The pin may also have a head, which may have a larger diameter than the shaft and may also be tapered, square, round or any other desired shape. Additionally the shaft of the pin may be circular, square or any other desired shape as well. In this manner, the pin inserted into a pin hole on a lower course of blocks in a wall may engage a core of a block in an upper course. This results in an interlocking of the blocks with a predetermined setback or no setback as desired.

Top surface 706 may have receiving channels 730. Receiving channels 730 extend from side wall 701 to cores 714 and 715. Receiving channels 730 also extend from side wall 702 to cores 714 and 715. Depending upon the application, receiving channels may be of sufficient width and depth as to accommodate a channel bar or other connection means for securing geogrid to the courses of blocks during construction of a retaining wall. Receiving channels 730 may also receive horizontal reinforcing materials such as rebar during the construction of a wall. It should be understood that the top and bottom surfaces of block 700 may be reversible. In other words, when block 700 is used in the construction of a wall either top surface 706 or bottom surface 705 may face downward.

Front surface 703 has a first area 707 and a second area 708 and both first area 707 and second area 708 may be on the same vertical plane. First area 707 and second area 708 combined form a total exposed area 710 of block 700. Total exposed area 710 may be the combined total surface areas of first area 707 and second area 708 and may also be the total surface area of front surface 703.

Figure 55:
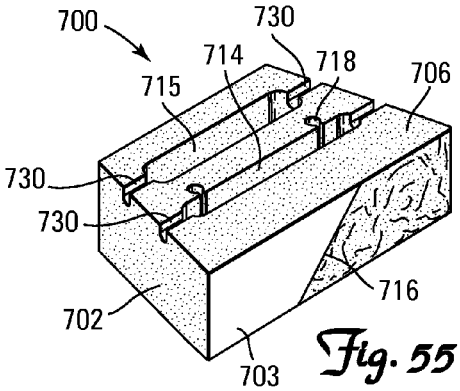
FIGS. 55 to 62 are top perspective, bottom perspective, front, top, bottom, back and side views, respectively, of an embodiment of a wall block.
Figure 56:
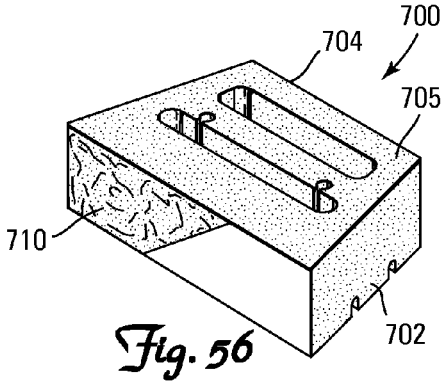
Figure 57:
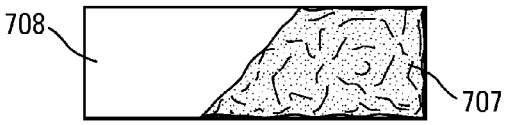
Figure 58:
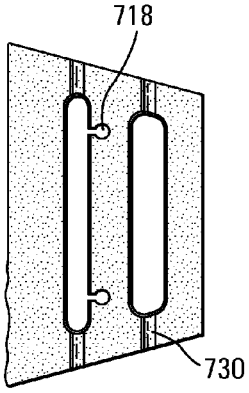
Figure 59:
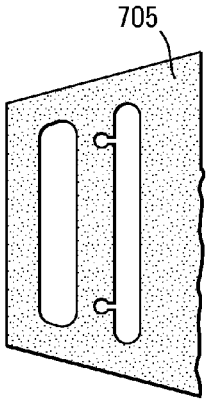
Figure 60:
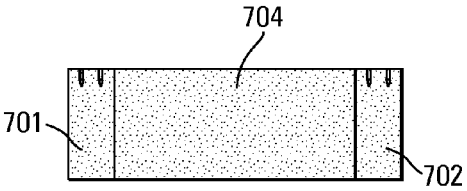
Figure 61:
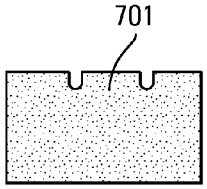
Figure 62:
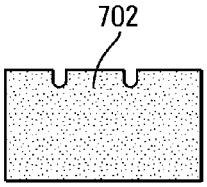
Figure 63:
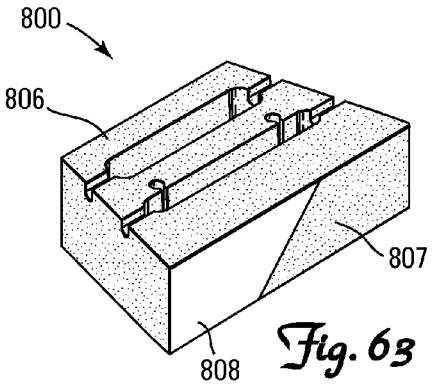
FIGS. 63 to 70 are top perspective, bottom perspective, front, top, bottom, back and side views, respectively, of an alternate embodiment of a wall block.
Figure 64:
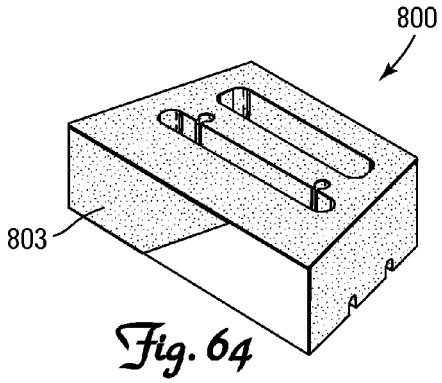
Figure 65:
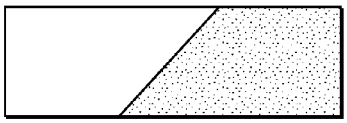
Figure 66:
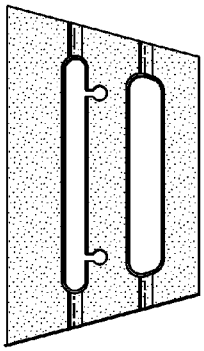
Figure 67:
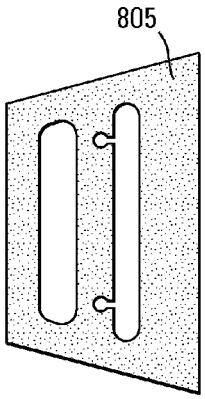

First area 707 is formed in a mold box with any desired first texture or pattern, and is shown in FIGS. 55 to 57 having a rough texture or a texture like that of natural stone. The boundary of first area 707 is formed by first side surface 701, bottom surface 705 and top surface 706 along with division boundary 716. Division boundary 716 is angled from the bottom surface 705 across front surface 703 to top surface 706. Division boundary 716 may have any angular slope as desired and could be 90 degrees or perpendicular to the top and bottom surfaces. The first area 707 boundary extends the entire length along first side surface 701, more than half of the length along bottom surface 705 and less than half the length along top surface 706 creating a trapezoid shape. It should be understood that the boundary of first area 707 is not limiting and could extend any distance as desired along any of the side surfaces and thus could have any size or shape.

Second area 708 is formed in a mold box with any desired second texture or pattern, the first texture or pattern of first area 707 being different than the second texture or pattern of second area 708. The boundary of second area 708 is formed by second side surface 702, bottom surface 705 and top surface 706 along with division boundary 716. Division boundary 716 may have any angular slope as desired and could be 90 degrees (orthogonal) or perpendicular to the top and bottom surfaces. The second area 708 boundary extends the entire length along second surface 702, more than half of the length along top surface 706 and less than half the length along bottom surface 705 creating a trapezoid shape. It should be understood that the boundary of first area 708 is not limiting and could extend any distance as desired along any of the side surfaces and thus could have any desired size or shape.

Alternate division boundary embodiments could separate first area 707 from second area 708. The division boundary could be perpendicular to bottom surface 705 and top surface 706. The division boundary could also have a 45 degree slope from the corner where first side surface 701 abuts the bottom surface 705, across front surface 703 to the corner where top surface 706 abuts second side surface 702. The division boundary could also be curvilinear. It should be understood that the division boundary could be linear or could have any type of shape or curve as desired and may be similar to the division boundaries shown in FIGS. 8 to 10.

First area 707 and second area 708 may be substantially equal in size, shape and surface area. Thus, first area 707 may cover around 50% of total exposed area 710 and second area 708 may also cover around 50% of total exposed area 710. It should be understood, however, that first area 707 and second area 708 may have any size, shape or surface area and thus the total proportion that first area 707 covers of front surface 703 (and exposed area 710) could be greater than or less than 50%. Additionally, the total proportion that the second area 708 covers of front surface 703 (and exposed area 710) could be greater than or less than 50%.

It should be understood that the patterns and designs of first area 707 and second area 708 are not limiting and any pattern or texture could be formed into or onto the first area and second area as desired. For example, either the first or second area may have a natural stone pattern, a brick and mortar pattern, a natural stone texture, or a substantially smooth texture or any pattern or texture, or combination of pattern and texture as desired. It should be further understood that the first area and second area may have the same pattern when the pattern is rotated from the first area to the second area such that the rotation of the pattern creates a different aesthetic between the first and second areas. It should be yet further understood that the first area and second area may both have the same pattern but with different textures. It should still be further understood that the first and second area could have the same pattern with different proportions or sizes in each of the first and second areas. It should be understood that first area 707 and second area 708 (along with any other additional areas as desired) may have similar sizes, shapes, proportions, patterns and textures as in FIGS. 11 to 26.

Though the blocks illustrated in the FIGS. 55 to 62 may have various dimensions, block 700 typically has a height (i.e., the distance between surfaces 706 and 705) of about 4 inches (102 mm), a body length (i.e., the distance from side wall 701 to side wall 702) of about 12 inches (304 mm) and a width (i.e., the distance from front face 703 to rear face 704) of about 7 inches (178 mm).

FIGS. 63 to 70 illustrate an alternate embodiment of the wall block of FIGS. 55 to 62. Wall block 800 is substantially similar to wall block 700 except that back surface 804 has a first area 827 and a second area 828. Both first area 827 and second area 828 may be on the same vertical plane. First area 827 and second area 828 combined form a total exposed area 840 of block 800. Total exposed area 840 may be the combined total surface areas of first area 827 and second area 828 and may also be the total surface area of rear surface 804.

Figure 68:
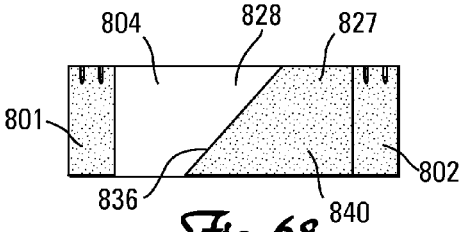
Figure 69:
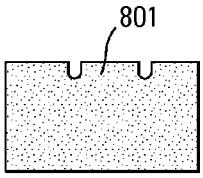
Figure 70:
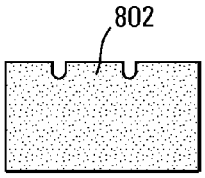

First area 827 is formed in a mold box with any desired first texture or pattern, and is shown in FIG. 68 having a rough texture or a texture like that of natural stone. The boundary of first area 827 is formed by second side surface 802, bottom surface 805 and top surface 806 along with division boundary 836. Division boundary 836 is angled from the bottom surface 805 across rear surface 804 to top surface 806. Division boundary 836 may have any angular slope as desired and could be 90 degrees or perpendicular to the top and bottom surfaces. The first area 827 boundary extends the entire length along second side surface 802, more than half of the length along bottom surface 805 and less than half the length along top surface 806 creating a trapezoid shape. It should be understood that the boundary of first area 827 is not limiting and could extend any distance as desired along any of the side surfaces and thus could have any size or shape.

Second area 828 is formed in a mold box with any desired second texture or pattern, the first texture or pattern of first area 827 being different than the second texture or pattern of second area 828. The boundary of second area 828 is formed by first side surface 801, bottom surface 805 and top surface 806 along with division boundary 836. The second area 828 boundary extends the entire length along first side surface 801, more than half of the length along top surface 806 and less than half the length along bottom surface 805 creating a trapezoid shape. It should be understood that the boundary of second area 828 is not limiting and could extend any distance as desired along any of the side surfaces and thus could have any desired size or shape.

It should be understood that the patterns and designs of first area 827 and second area 828 are not limiting and any pattern or texture could be formed into or onto the first area and second area as desired and may be the same as the patterns or textures of first area 807 and second area 808 of front face 803 or may be different.

FIGS. 71 to 78 illustrate an alternate embodiment of the wall block of FIGS. 55 to 62. Wall block 900 is substantially similar to wall block 700 except that front surface 903 has a first area 907 and a second area 908 on different vertical planes and there are no channels or pin holes in the block body. Second area 908 may be recessed or set back into the block body from first area 907. First area 907 and second area 908 combined form a total exposed area 910 of block 900. Total exposed area 910 may be the combined total surface areas of first area 907 and second area 908. Division surface 917 (and division boundary 916) divides first area 907 from second area 908 and extends outward from the block body and from second area 908. First area 907, second area 908 and division surface 917 may be the combined total surface area of front surface 903. It should be understood that the block is not limiting and that the first area 907 may be recessed from second area 908.

Figure 71:
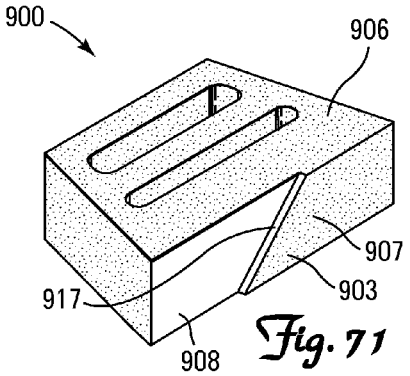
FIGS. 71 to 78 are top perspective, bottom perspective, front, top, bottom, back and side views, respectively, of an alternate embodiment of a wall block.
Figure 72:
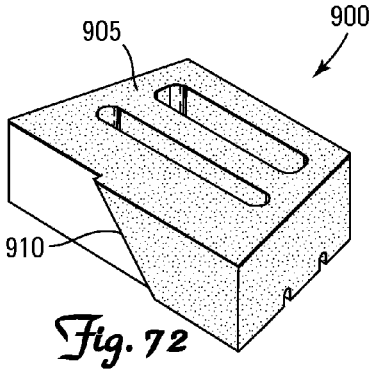
Figure 73:
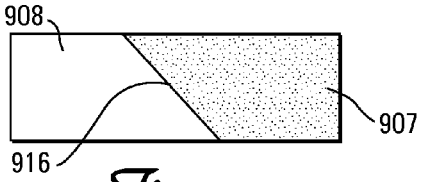
Figure 74:
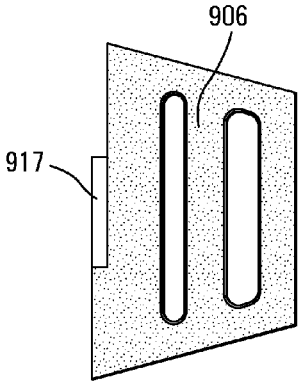
Figure 75:
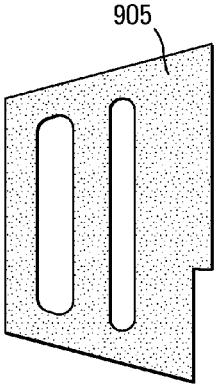
Figure 76:
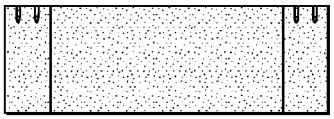
Figure 77:
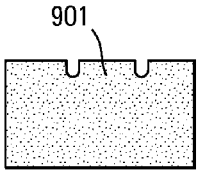
Figure 78:
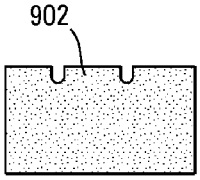

First area 907 is formed in a mold box with any desired first texture or pattern, and is shown in FIGS. 71 to 73 having a rough texture or a texture like that of natural stone. The boundary of first area 907 is formed by first side surface 901, bottom surface 905 and top surface 906 along with division boundary 916. Division boundary 916 is angled from the bottom surface 905 across front surface 903 to top surface 906. Division boundary 916 may have any angular slope as desired and could be 90 degrees or perpendicular to the top and bottom surfaces. The first area 907 boundary extends the entire length along first side surface 901, more than half of the length along bottom surface 905 and less than half the length along top surface 906 creating a trapezoid shape. It should be understood that the boundary of first area 907 is not limiting and could extend any distance as desired along any of the side surfaces and thus could have any size, proportion or shape.

Second area 908 is formed in a mold box with any desired second texture or pattern, the first texture or pattern of first area 907 being different than the second texture or pattern of second area 908. The boundary of second area 908 is formed by second side surface 902, bottom surface 905 and top surface 906 along with division boundary 916. The second area 908 boundary extends the entire length along second surface 902, more than half of the length along top surface 906 and less than half the length along bottom surface 905 creating a trapezoid shape. It should be understood that the boundary of first area 908 is not limiting and could extend any distance as desired along any of the side surfaces and thus could have any desired size, proportion or shape.

It should be understood that the patterns and designs of first area 907 and second area 908 are not limiting and any pattern or texture could be formed into or onto the first area and second area as desired. It should further be understood that division surface 917 could have any pattern or texture as desired and could be the same as that of the first area or second area or could be different than both the first and second areas.

FIGS. 79 to 82 show walls, fences or portions of walls or fences built with block 700. It should be understood that the walls of FIGS. 79 to 82 could be constructed with any of blocks 700, 800 or 900. Generally, when constructing a wall, a trench is excavated to a pre-selected depth and partially filled with a level base of granular material such as crushed stone. A base layer of blocks are then placed and leveled onto the crushed stone. The blocks are placed side to side with front face 703 facing outward and the bottom surface 705 or top surface 706 facing downward. When the pinning system is utilized, pins are placed into pin hole of the upward facing surface of the blocks. The heads of the pins are then received in the cores, channels or pin receiving cavities in the downward facing surface of the upper adjacent course of blocks. Subsequent layers of blocks can then be placed one on top of the next with the pin connection system until the desired height is reached. Once the base layer is laid, the second layer is laid with the bottom surface 705 or the top surface 706 of the blocks of the second layer placed upon the top surface 706 (or bottom surface) of the blocks of the base layer. It should be noted that when the block is used in constructing a gravity wall, the weight of the blocks may be sufficient for connection without the use of the pinning system. When the desired height of the wall is achieved a cap or finish layer may be added.

Figure 79:
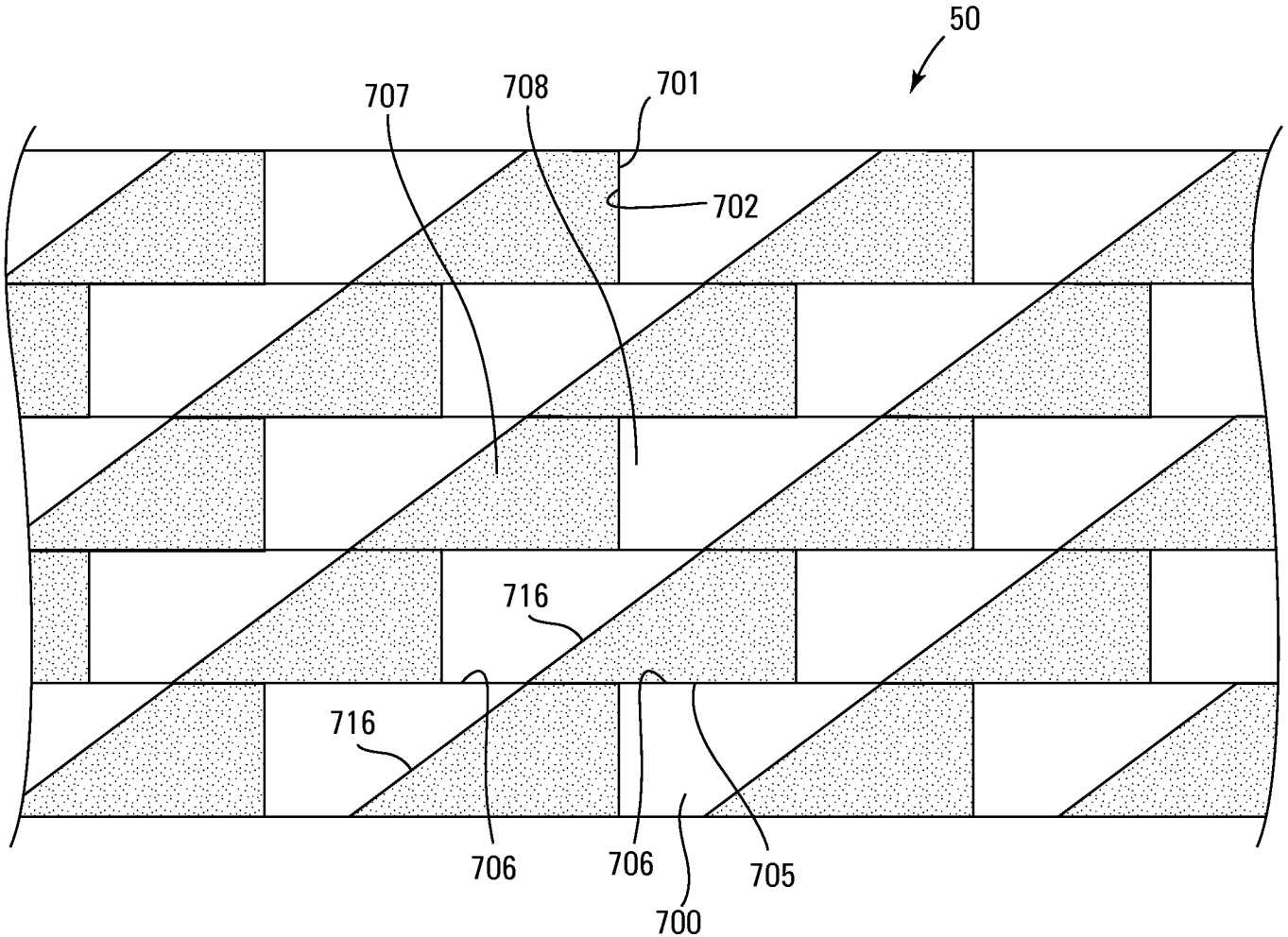
Figure 8O:
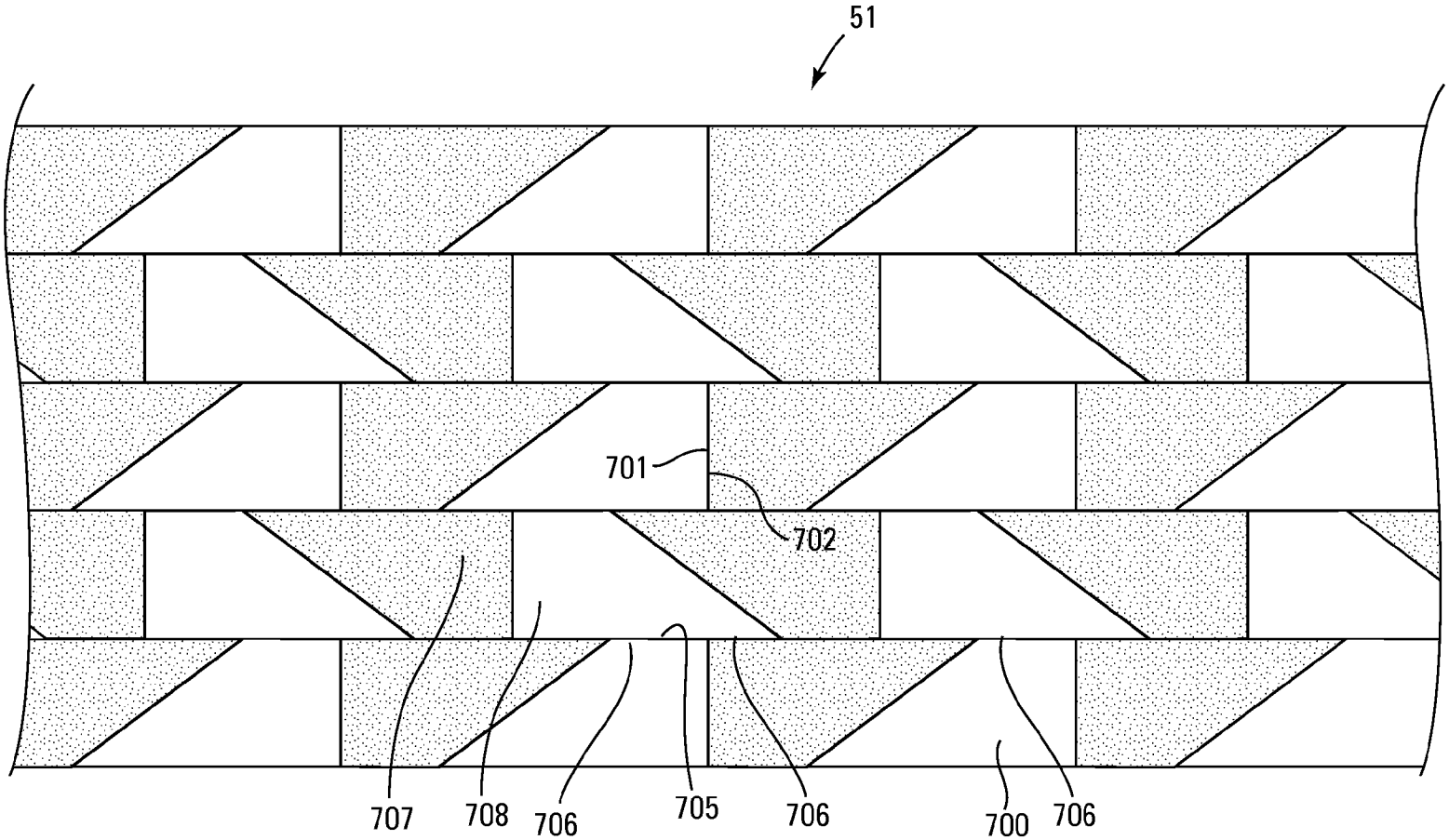

FIG. 79 shows wall 50 wherein wall block 700 is positioned such that the first area 707 of one wall block is directly adjacent the second area 708 of an adjacent wall block (and vice versa) in a course of blocks and such that side surface 701 of one wall block is directly adjacent side surface 702 of an adjacent wall block. Additionally, wall block 700 is positioned such that the bottom surface 705 of one wall block in a course of blocks is directly adjacent to the top surface 706 of two wall blocks in an adjacent course and such that division boundary 716 in a course of blocks is aligned with the division boundary in an adjacent course of blocks to form a continuous slope of the division boundary from one course of blocks to the next course of blocks.

FIG. 80 shows wall 51 wherein wall block 700 is positioned such that the first area 707 of one wall block in a course of blocks is directly adjacent the second area 708 of an adjacent wall block (and vice versa) in a course of blocks and such that side surface 701 of one wall block is directly adjacent side surface 702 of an adjacent wall block. Additionally, wall block 700 is positioned such that the bottom surface 705 is always positioned facing upward and such that bottom surface 705 is directly adjacent the top surface 706 of two blocks 700 in an upper course of blocks.

Figure 81:
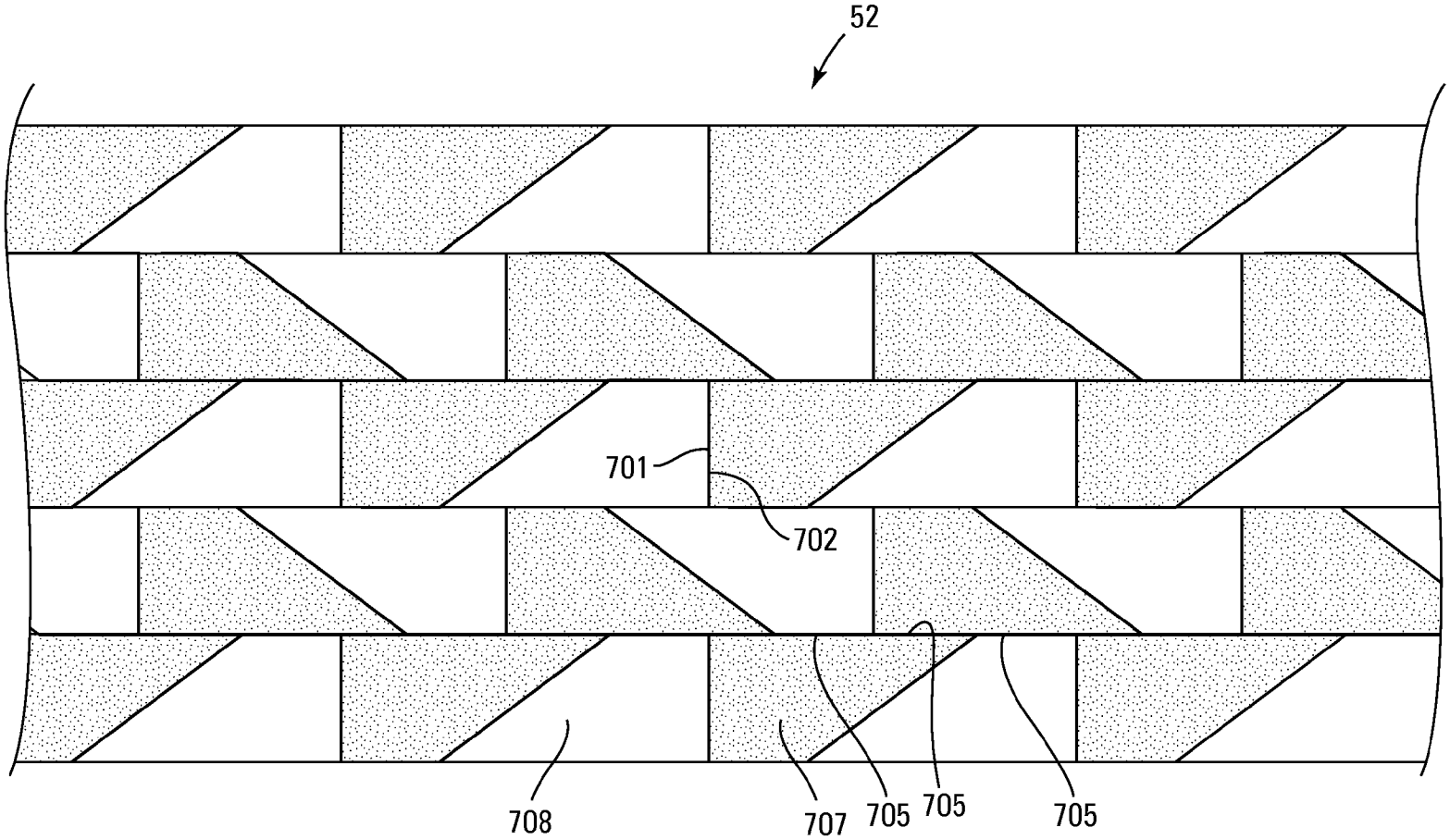

FIG. 81 shows wall 51 wherein wall block 700 is positioned such that the first area 707 of one wall block in a course of blocks is directly adjacent the second area 708 of an adjacent wall block (and vice versa) in a course of blocks and such that side surface 701 of one wall block is directly adjacent side surface 702 of an adjacent wall block. Additionally, wall block 700 is positioned such that the bottom surface 705 is positioned facing upward in every other course of blocks and such that bottom surface 705 is directly adjacent the bottom surface 705 of two blocks 700 in an upper course of blocks.

Figure 82:
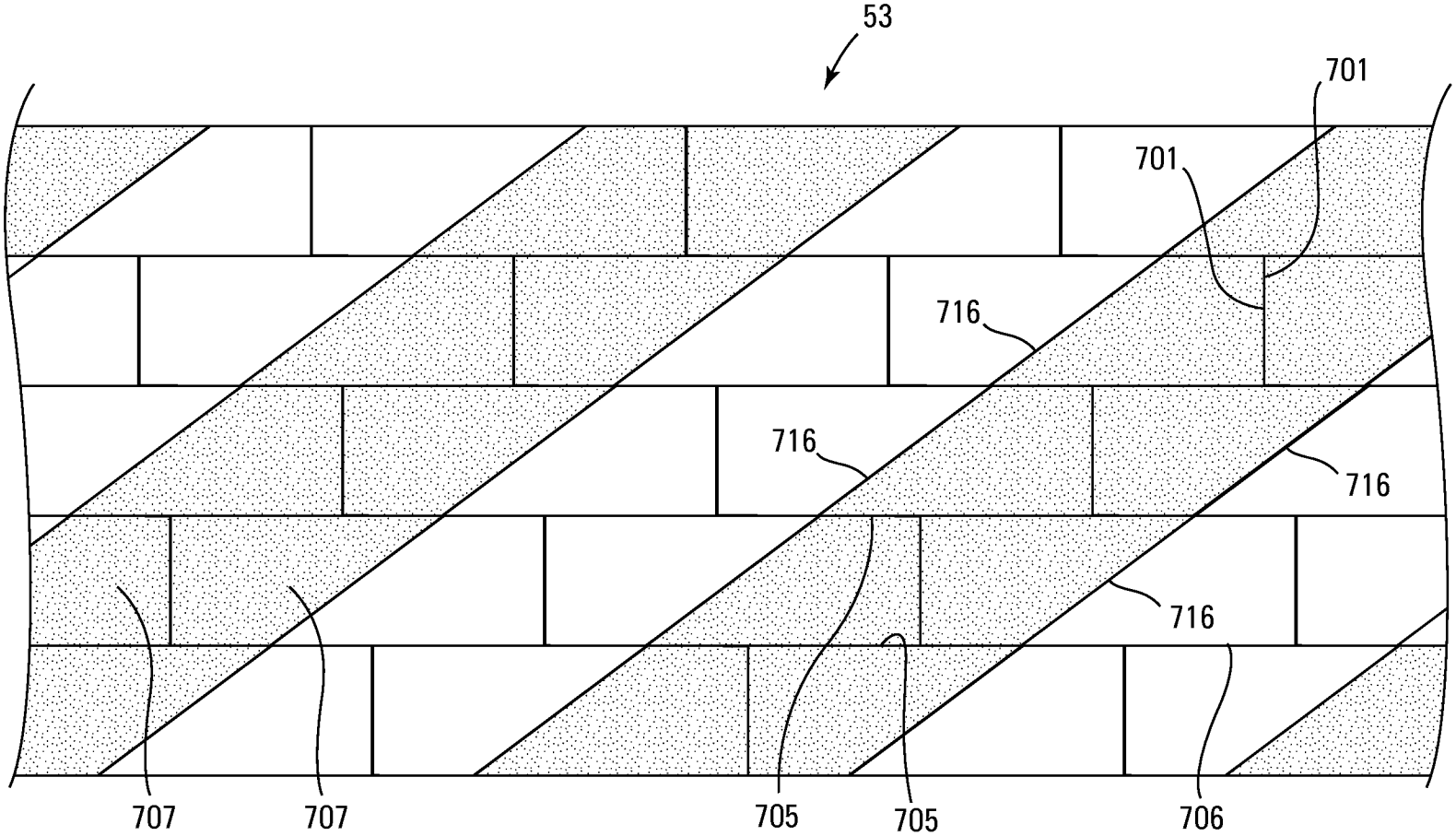

FIG. 82 shows wall 53 wherein wall block 700 is positioned such that the first area 707 of one wall block in a course of blocks is directly adjacent the first area 707 of an adjacent wall block in the course of blocks and such that first side surface 701 of one wall block is directly adjacent first side surface 701 of another wall block in a course of blocks. Additionally, wall block 700 is positioned such that the bottom surface 705 of one wall block in a course of blocks is directly adjacent to the top surface 706 of one wall block and the bottom surface 705 of another wall block in an adjacent course and such that division boundary 716 in a course of blocks is aligned with the division boundary in an adjacent course of blocks to form a continuous slope of the division boundary from one course of blocks to the next course of blocks.

Figure 83:
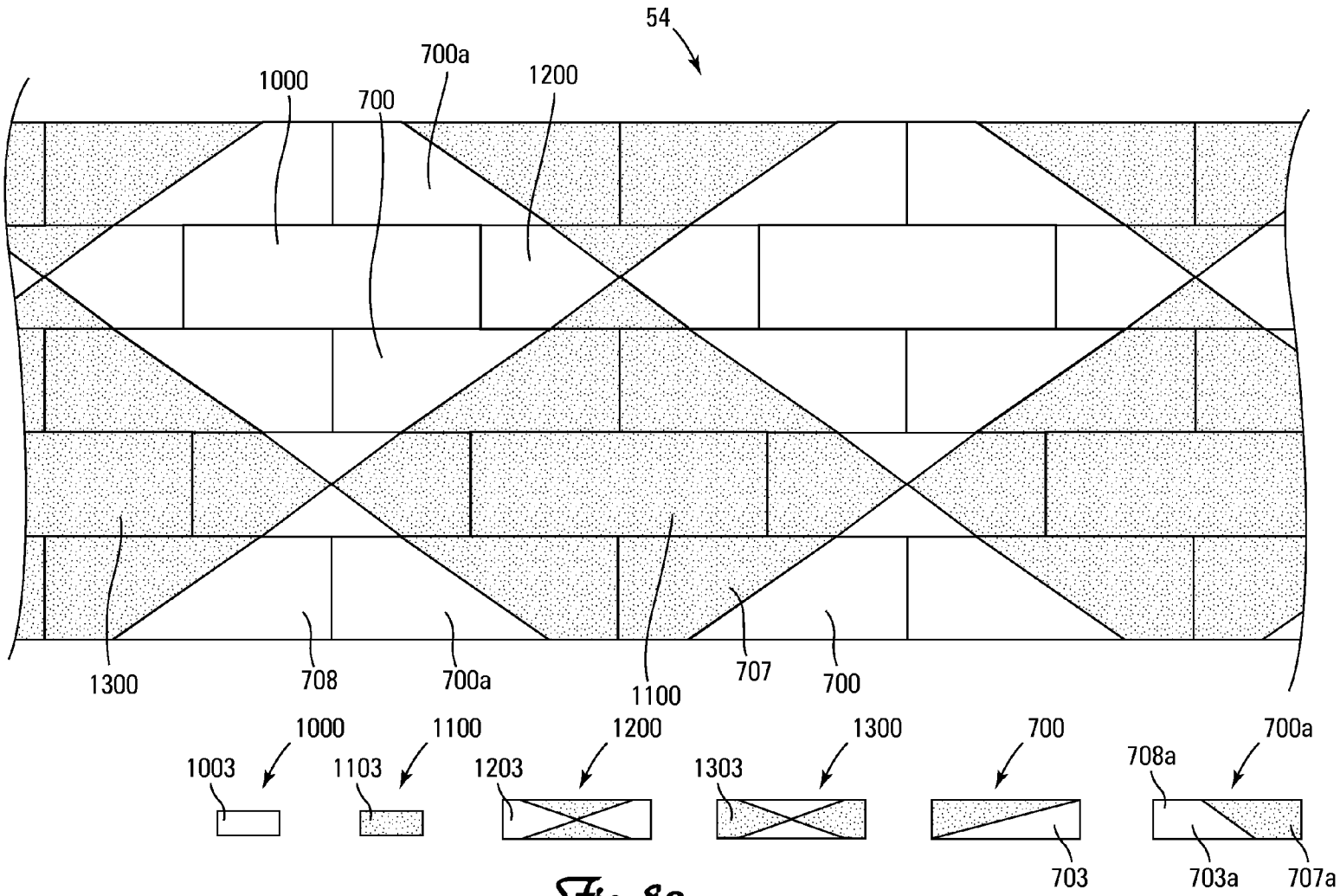
FIG. 83 is a front view of a wall with an optional pattern constructed from the wall block of FIGS. 55 to 62, and first, second, third and fourth alternate embodiments of wall blocks.

FIG. 83 shows wall 54 constructed from block 700 and alternate embodiment blocks 700*a*, 1000, 1100, 1200 and 1300. Alternate block embodiment 700*a* is substantially similar in size and shape to block 700 except that first and second areas 707*a* and 708*a*, respectively, of front face 703*a* are mirror images of first and second areas 707 and 708 of front face 703 of block 700. Alternate block embodiment 1000 is substantially similar in size and shape to block 700 except that front face 1003 has one area and is one texture or pattern. Alternate block embodiment 1100 is substantially similar in size and shape to block 700 except that front face 1103 has one area and is one texture or pattern, the texture or pattern being different from the texture or pattern of block 1000. Alternate block embodiment 1200 is substantially similar in size and shape to block 700 except that block 1200 has four separate areas on front face 1203 with the first and second areas having the same texture or pattern and the third and fourth areas having the same texture or pattern but a different pattern or texture than the first and second areas. Alternate block embodiment 1300 is substantially similar in size and shape to block 700 except that block 1300 has four separate areas on front face 1303 with the first and second areas having the same texture or pattern and the third and fourth areas having the same texture or pattern but a different pattern or texture than the first and second areas. It should be understood that the front faces of blocks 700*a*, 1000, 1100, 1200 and 1300 are not limiting and could have any desired pattern or texture. It should further be understood that the areas and patterns or textures of the front faces of blocks 700*a*, 1000, 1100, 1200 and 1300 could be molded onto or into the back faces any of the other wall blocks to reduce the overall number of block types used in constructing wall 54.

Wall 54 is constructed with a diamond pattern such that a first course of wall blocks is constructed with alternating blocks 1000 and 1200. The next upper adjacent course of blocks is constructed with wall blocks 700 and 700*a* positioned such that the top surface is facing downward and the first area 707 of block 700 is place directly adjacent the first area 707*a* of an adjacent block 700*a* and the second area 708 of block 700 is placed directly adjacent the second area 708*a* of an adjacent block 700*a*. The next upper adjacent course is constructed with alternating blocks 1100 and 1300. The next upper adjacent course of blocks is constructed with wall blocks 700 and 700*a* positioned such that the top surface is facing upward and the first area 707 is place directly adjacent the first area 707*a* of the adjacent block and the second area 708 is placed directly adjacent the second area 708*a* of an adjacent block. The next upper course completes the diamond pattern in the wall and is constructed with alternating blocks 1000 and 1200. The pattern may be repeated as many times as desired depending upon the height of the wall.

Figure 84:
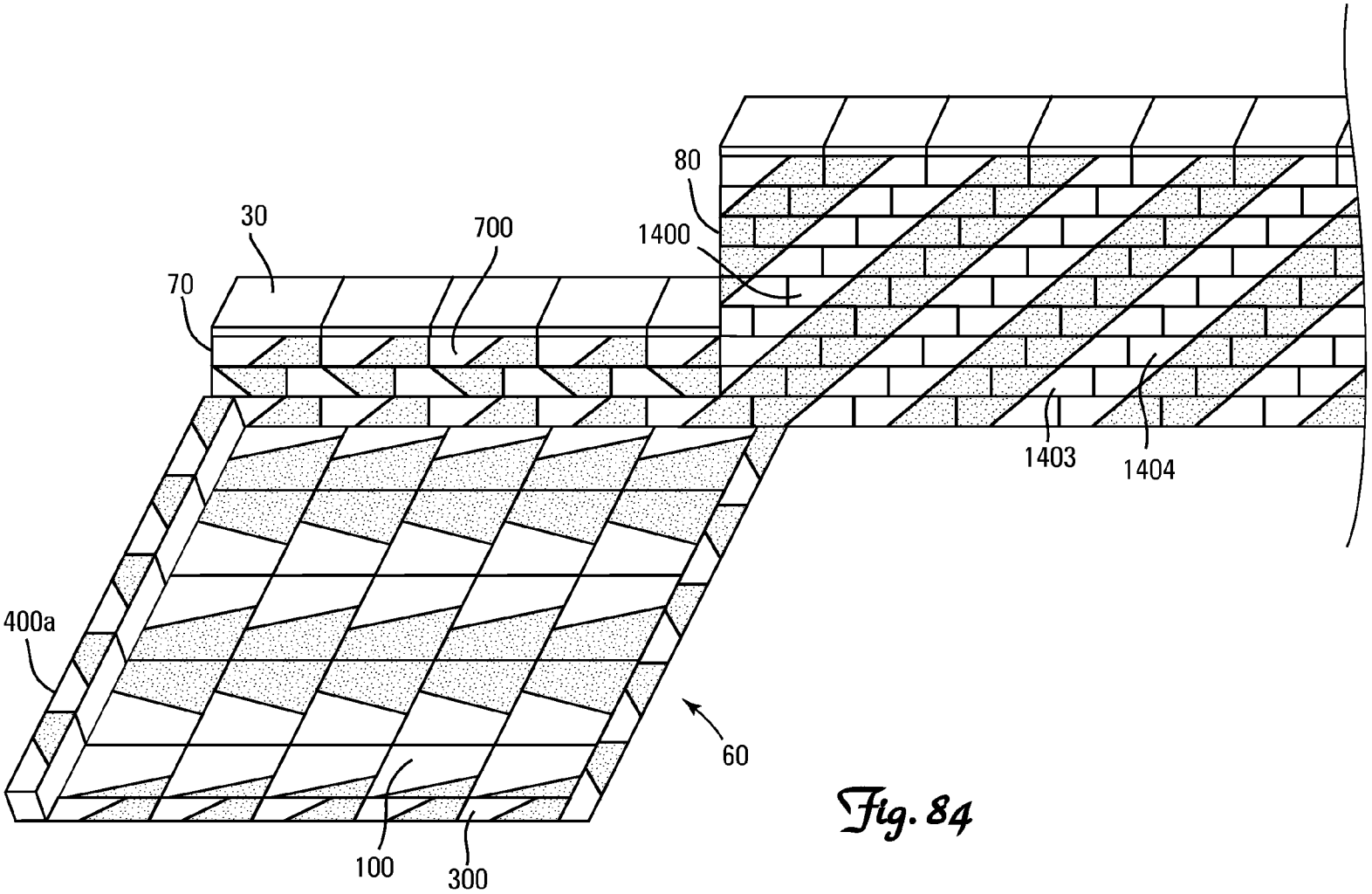
FIG. 84 is a front perspective view of an alternate embodiment of a patio, retaining wall and fence constructed with the landscaping blocks of FIGS. 1 to 7, the landscaping and edger blocks of FIG. 39, the wall blocks of FIGS. 55 to 62 and an alternate embodiment of a wall block.

FIG. 84 shows a patio 60, retaining wall 70 and fence 80 constructed from patio blocks 100 and 300, edger block 400*a*, wall blocks 700, alternate embodiment wall block 1400 and capping block 30. The patio constructed from blocks 100, 300 and edger 400*a* is substantially similar the patio described above in relation to FIG. 39. Two sides of the patio have been bordered with block 300 which is substantially similar to block 100 except that side surfaces 301 and 302 of block 300 are less than the length of side surfaces 101 and 102 of block 100 and may be about 25% of the length of side surfaces 101 and 102. One side of the patio has been bordered with edger block 400*a*. Edger block 400*a* is similar to block 300 except that the height of side surfaces 401*a*, 402*a*, 403*a* and 404*a* is greater than that of the height of the side surfaces of block 300. Additionally side surface 403*a* and 404*a* have also been given a first and second area with different patterns or textures as in top surface 406*a*, top surface 306 of block 300 and top surface 106 of block 100. One side of the patio has been bordered with a retaining wall 70 and fence 80. Retaining wall 70 has been constructed with wall blocks 700 and the front or exposed surface of the retaining wall has the same pattern as wall 52. Fence 80 has been constructed with alternate wall block 1400 which is substantially similar to wall block 800 except that wall block 1400 is rectangular with no converging side surfaces and a front face and a rear face having the same total area. The front face and the rear face each having a first area and a second area, the first area having a first pattern or texture and the second area having a different pattern or texture. Fence 80 is constructed with both front faces 1403 and rear faces 1404 facing outward. The retaining wall 70 and fence 80 have been given a capping layer 30. The capping blocks of capping layer 30 are not limiting and could each be given a top surface with a first area and a second area, the first area having a texture or pattern and the second area having a different texture or pattern.

Although particular embodiments have been disclosed herein in detail, this has been done for purposes of illustration only, and is not intended to be limiting with respect to the scope of the appended claims, which follow. In particular, it is contemplated by the inventor that various substitutions, alterations, and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A patio system comprising:

a plurality of patio blocks, the patio blocks having a first side surface opposed from a second side surface, a third side surface opposed from a fourth side surface, and opposed top and bottom surfaces, the first, second, third and fourth side surfaces having a length, the top surface having a total upper area on a horizontal plane, the total upper area of the top surface having a first area with a first pattern or texture and a second area with a second pattern or texture, the first pattern or texture being different from the second pattern or texture, the first area being separated from the second area along a linear division boundary extending at an angle from the third side surface to the fourth side surface such that the division boundary is not parallel to either the first side surface or the second side surface, the division boundary having a lower surface that is recessed from the top surface, a first angular surface extending from the first area of the total upper area to the lower surface and a second angular surface extending from the second area of the total upper area to the lower surface, the first area being shaped to extend an entire distance across the total upper area from the third side surface to the fourth side surface and a partial distance across the total upper area from the first side surface toward the second side surface and the second area being shaped to extend an entire distance across the total upper area from the third side surface to the fourth side surface and a partial distance across the total upper area from the second side surface toward the first side surface; and wherein the first and second areas are shaped such that when a patio is made with the plurality of patio blocks, any of the first, second, third or fourth side surfaces of a patio block may be laid adjacent to any of the first, second, third or fourth side surfaces of an adjacent patio block such that the first and second areas of the plurality of patio blocks create a variety of patio surface patterns.

2. The patio system of claim 1 wherein the first area of the total upper area of the top surface is equal in size to the second area of the total upper area of the top surface.

3. The patio system of claim 1 wherein the first area extends across the total upper area of the top surface from the first side surface toward the second side surface along the third side surface more than half of the length of the third side surface.

4. The patio system of claim 3 wherein the first area extends across the total upper area of the top surface from the first side surface toward the second side surface along the fourth side surface a distance less than half of the length of the fourth side surface.

5. The patio system of claim 4 wherein the second area extends across the upper area of the top surface from the second side surface toward the first side surface along the third side surface a distance less than half of the length of the third side surface and the second area extends across the upper area of the top surface from the second side surface toward the first side surface along the fourth side surface a distance more than half of the length of the fourth side surface.

6. The patio system of claim 1 wherein the first and second areas of the plurality of patio blocks are shaped to create a variety of patio surface patterns such that a patio made with a plurality of patio blocks positioned such that the first side surface of the patio blocks is laid adjacent only to the first side surface of an adjacent patio block creates a first patio surface pattern, a patio made with a plurality of patio blocks positioned such that the second side surface of the patio blocks is laid adjacent only to the second side surface of an adjacent patio block creates a second patio surface pattern, a patio made with a plurality of patio blocks positioned such that the second side surface of the patio blocks is laid adjacent only to the third side surface or fourth side surface of an adjacent patio block creates a third patio surface pattern, a patio made with a plurality of patio blocks positioned such that the first side surface of the patio blocks is laid adjacent only to the second side surface of an adjacent patio block creates a fourth patio surface pattern, a patio made with a plurality of patio blocks positioned such that the third side surface of the patio blocks is laid adjacent only to the third side surface or fourth side surface of an adjacent patio block creates a fifth patio surface pattern, a patio made with a plurality of patio blocks positioned such that the first side surface of the patio blocks is laid adjacent only to the third side surface of an adjacent patio and the second side surface of the patio blocks is laid adjacent only to the fourth side surface of an adjacent patio block creates a sixth patio surface pattern.

7. The patio system of claim 1 wherein at least some of the plurality of patio blocks have a first block size and at least some of the plurality of patio blocks have a second block size different from the first block size.

8. The patio system of claim 7 wherein the patio blocks having a first block size and the patio blocks having a second block size each have a same first block shape.

9. The patio system of claim 8 wherein each of the first, second, third and fourth side surfaces of the patio blocks having the first block size are laid adjacent to any of the first, second, third and fourth side surfaces of four of the patio blocks having the second block size.

10. The patio system of claim 8 wherein at least some of the plurality of patio blocks have a third block size different from the first block size and second block size and wherein the patio blocks having a third block size have a second block shape different from the first block shape.

11. The patio system of claim 1 wherein at least some of the plurality of patio blocks have a first block shape and at least some of the plurality of patio blocks have a second block shape different from the first block shape.

12. The patio system of claim 11 wherein when a patio is made with the plurality of patio blocks, any of the first, second, third and fourth side surfaces of patio blocks having the first block shape are laid against any of the first, second, third and fourth side surfaces of patio blocks having the second block shape located along a perimeter of the patio.

13. The patio system of claim 1 wherein the plurality of patio blocks have a height as measured from the top surface to the bottom surface and wherein at least some of the plurality of patio blocks have a first block height and at least some of the plurality of patio blocks have a second block height different from the first block height.

14. The patio system of claim 13 wherein the patio blocks having a first block height have a first block shape and the patio blocks having a second block height have a second block shape, the second block shape being different from the first block shape.

15. The patio system of claim 14 wherein when a patio is made with the plurality of patio blocks, any of the first, second, third and fourth side surfaces of patio blocks having the first block height and first block shape are laid against any of the first, second, third and fourth side surfaces of patio blocks having the second block height and second block shape located along a perimeter of the patio.

16. A method of making a patio comprising:

providing a plurality of patio blocks, the patio blocks having a first side surface opposed from a second side surface, a third side surface opposed from a fourth side surface, and opposed top and bottom surfaces, the top surface having a total upper area, the total upper area of the top surface having a first area with a first pattern or texture and a second area with a second pattern or texture, the first pattern or texture being different from the second pattern or texture, the first area being separated from the second area along a linear division boundary extending at an angle from the third side surface to the fourth side surface such that the division boundary is not parallel to either the first side surface or the second side surface, the division boundary having a lower surface that is recessed from the top surface, a first angular surface extending from the first area of the total upper area to the lower surface and a second angular surface extending from the second area of the total upper area to the lower surface, the first area being shaped to extend an entire distance across the total upper area from the third side surface to the fourth side surface and a partial distance across the total upper area from the first side surface toward the second side surface and the second area being shaped to extend an entire distance across the total upper area from the third side surface to the fourth side surface and a partial distance across the total upper area from the second side surface toward the first side surface; and forming a patio by positioning the patio blocks such that one of the first, second, third or fourth side surfaces of each patio block is laid adjacent to one of the first, second, third or fourth side surfaces of an adjacent block.

17. The method of claim 16 wherein at least some of the plurality of patio blocks have a first block size and at least some of the plurality of patio blocks have a second block size different from the first block size and wherein the patio blocks having a first block size and the patio blocks having a second block size each have a same first block shape.

18. The method of claim 17 wherein at least some of the plurality of patio blocks have a third block size different from the first block size and second block size and the patio blocks having a third block size have a second block shape different from the first block shape and wherein any of the first, second, third and fourth side surfaces of patio blocks having the first block shape are laid against any of the first, second, third and fourth side surfaces of patio blocks having the second block shape located along a perimeter of the patio.

19. The method of claim 16 wherein at least some of the plurality of patio blocks have a first block shape and at least some of the plurality of patio blocks have a second block shape different from the first block shape and wherein any of the first, second, third and fourth side surfaces of patio blocks having the first block shape are laid against any of the first, second, third and fourth side surfaces of patio blocks having the second block shape located along a perimeter of the patio.

20. The method of claim 16 wherein the plurality of patio blocks have a height as measured from the top surface to the bottom surface and at least some of the plurality of patio blocks have a first block height and at least some of the plurality of patio blocks have a second block height different from the first block height and wherein any of the first, second, third and fourth side surfaces of patio blocks having the first block height are laid against any of the first, second, third and fourth side surfaces of patio blocks having the second block height located along a perimeter of the patio.

* * * * *